US006272888B1

(12) United States Patent
Fujita et al.

(10) Patent No.: US 6,272,888 B1
(45) Date of Patent: Aug. 14, 2001

(54) CLOTHES FOR SMALL CHILDREN INCLUDING BABY AND INFANT

(75) Inventors: Hiyoshi Fujita; Hisako Komori, both of Kyoto (JP)

(73) Assignee: Wacoal Corp., Kyoto-Fu (JP)

( * ) Notice: Subject to any disclaimer, the term of this patent is extended or adjusted under 35 U.S.C. 154(b) by 0 days.

(21) Appl. No.: 09/077,455

(22) PCT Filed: Oct. 23, 1997

(86) PCT No.: PCT/JP97/03831

§ 371 Date: Oct. 21, 1998

§ 102(e) Date: Oct. 21, 1998

(87) PCT Pub. No.: WO98/20191

PCT Pub. Date: May 14, 1998

(30) Foreign Application Priority Data

Nov. 1, 1996 (JP) ..... 8-292163

(51) Int. Cl.[7] ..... A41B 13/08

(52) U.S. Cl. ..... 66/172 E; 66/175; 66/176; 66/177; 2/80; 2/111

(58) Field of Search ..... 2/71, 73, 75, 77, 2/78.1, 78.3, 79, 80, 109, 111, 113, 114, 400, 401, 402, 403, 404, 406, 407; 450/95, 115, 116, 117, 118, 130, 131; 66/171, 172 E, 176, 177, 194, 175

(56) References Cited

U.S. PATENT DOCUMENTS

| | | | | |
|---|---|---|---|---|
| 672,028 | * | 4/1901 | Appleton | 66/176 |
| 2,450,631 | * | 10/1948 | Buchler | 2/80 |
| 2,576,812 | * | 11/1951 | Siegel | 2/80 |
| 2,613,360 | * | 10/1952 | Friedland et al. | 2/80 |
| 2,663,022 | * | 12/1953 | Aaronson | 2/80 |
| 2,876,455 | * | 3/1959 | Harmon | 2/80 |
| 4,180,065 | * | 12/1979 | Bowen | 66/172 E |
| 5,431,030 | * | 7/1995 | Ishizaki et al. | 66/176 |
| 5,465,594 | | 11/1995 | Imboden et al. | 66/177 |
| 5,787,512 | * | 8/1998 | Knox | 66/171 |

FOREIGN PATENT DOCUMENTS

| | | | |
|---|---|---|---|
| 0 599 266 | 6/1994 | (EP) | D04B/1/24 |
| 2093212 | 1/1972 | (FR) | D04B/1/00 |
| 2 146 050 | 4/1985 | (GB) | D04B/9/10 |

* cited by examiner

*Primary Examiner*—Danny Worrell
(74) *Attorney, Agent, or Firm*—Sughrue, Mion, Zinn, Macpeak & Seas, PLLC

(57) ABSTRACT

Clothes which are used for small children including babies and infants are formed of elastic knitted fabric having thread knitted by a knitting machine. The thread of a belly part of the clothes, a crotchpart thereof, sidepart thereof and sleeve part thereof are knitted by a different method to differentiate expansiveness of each part. The belly part of the clothes bulges and wraps a baby's belly three-dimensionally, and is more expansive than other parts of the clothes.

18 Claims, 21 Drawing Sheets

(A)

(B)

(A)

(B)

(A)

(B)

(A)

(B)

(A)

(B)

(A)

(B)

(A)

(B)

(A)

(B)

(A)

(B)

CLOTHES FOR SMALL CHILDREN INCLUDING BABY AND INFANT

TECHNICAL FIELD

The present invention relates to clothes for small children including babies and infants and more particularly to clothes which are used mainly as underwear of small children aged up to about to six years. In particular, the present invention relates to clothes having a structure which can be used for a long time irrespective of the change in the body shape and body size of small children because of their bodily growth and which is expansive in conformity to their actions changing according to the age (month age) of the babies and the age of infants, and having no stimulation for their soft skins.

BACKGROUND ART

Most underwear for small children and in particular those for babies and infants are hitherto formed not of knitted synthesized fiber but of knitted fabric consisting of 100 percent cotton to prevent their soft skins from being stimulated.

That is, undershirts used as top clothes, panties and used as bottom clothes, and coveralls and rompers consisting of the top clothes and the bottom clothes integral therewith are formed by cutting knitted 100 percent cotton into a pattern corresponding to each of the front body, the rear body, and the sleeve and sewing the cut patterns to each other. Mostly, a rubber string is tightly attached to the open end of the sleeve, the lower end of the leg, and the waist part of clothes.

The clothes including underwear consisting of knitted 100 percent cotton lack elasticity and the elasticity cannot be partly changed.

Therefore, the conventional underwear consisting of knitted 100 percent cotton are incapable of following the change in the bodily structure of babies and infants and small children that is made in a great extent because their bodies grow rapidly in a short period of time, thus having a short period of time in use.

Different from adults and children who have reached the school age, babies and infants have a formative feature or a bodily structural feature that they have bellies bulged forward. Underwear and outdoor clothes adapted for this particular feature have not been proposed. In particular, in clothes which consist of a top and bottom portion continuous with each other such as rompers, the part of the clothes corresponding to the bulged belly are required to have a higher degree of elasticity than the other parts thereof in order to achieve conformity to the bulged belly. But the conventional clothes are incapable of doing so and consequently, the part is too large or too small. Thus, the conventional clothes do not fit to the body well.

As described above, babies and infants have bulged bellies, and the formative feature or the bodily structural feature and the actional characteristics are varied greatly depending on growth stages. Thus, it is necessary that the clothes correspond to the formative feature and the actional characteristic of each growth stage but the conventional clothes are not formed in conformity to the change in the formative feature and the actional characteristic. Therefore, the conventional clothes do not fit well to the body of the baby and infant and may obstruct the motion function thereof.

In the case of babies of the first stage, namely, those aged two–four months, the growth speed of the bodies thereof in this stage is faster than any other stage in their lives. The feature of their bodily structure is that they a have long trunk, short legs, and bulged bellies. As the actional characteristic, they lie or turn in their beds and bend and stretch their hands and legs and move their hands and legs while lying on their bellies. Thus, it is most important in their first growth stage to allow clothes to be elastic according to the change in the size of their bulged bellies and allow the clothes to be put on them easily and removed therefrom easily because they keep lying in their beds.

The growth speed of their bodies in the second growth stage, namely, those aged three to eight months from birth becomes slower than that in their first growth stage, but their buttocks become bigger than their bellies. In their actional characteristic, they can turn over in their beds and sit by themselves, i.e., they spend much time sitting. Accordingly, it is important in the second growth stage that clothes are so formed as to correspond to the change in the size of the waist (buttocks) and preferable that the clothes are not loose in the waist part thereof when they sit and are held in the hands of mother or the like.

In the third growth stage, i.e., when they are 6–15 months old, as the formative characteristic, the lower parts of the body grow, and as the actional characteristic, they become active. They can stand by holding something in their hands, stand by themselves or walk by themselves. That is, in the third growth stage, they spend much time standing. Accordingly, in the third stage, it is important that the side of clothes is expansive in conformity to their actions. In particular, the expansion of the part of clothes corresponding to the side of their bodies increases because of their upward motion of their hands and legs. Thus, it is important that the part of the clothes corresponding to the side of their body follows their actions.

As described above, because the growth speed is highest and the formative change is greatest in babies and infants aged 0–15 months throughout their lives, it is desirable that clothes and in particular, underwear can adapt for the their rapid growth and the actional characteristic of each growth stage so that the clothes do not prevent their bodily growth and motion function.

Because small children before school age still have bulged bellies and are very active, it is preferable that clothes correspond to their formative and actional characteristics.

However, as described previously, the conventional clothes for small children including babies and infants are not designed in consideration of their actional characteristics in each growth process. Thus, it can be safely said that the conventional clothes lack the action of developing and accelerating their motion function.

Clothes and underwear in particular for small children including babies and infants are washed frequently. When the conventional underwear consisting of 100 percent cotton are expanded, they are not returned to the original shape, i.e., they become out of shape. Further, the skins of babies and infants are about ⅓ as thick as that of adult's skin and thus are susceptible to stimulus. The conventional underwear have many sewing portions which touch the soft skins of babies and infants and stimulate and roughen the skins.

DISCLOSURE OF INVENTION

The present invention has been made in view of the above-described problems. It is accordingly an object of the present invention to provide clothes which are used as underwear which are expansive in conformity to the change in the bodily structure and action of babies aged 0–15 months and infants aged from about 15 months–about six years; fit well to their bodies, accelerate motion function; can be used for a long time; do not roughen their skins; and do not get out of shape. The clothes of the present invention are not limited to the underwear but may be used as outdoor clothes.

In order to solve the problems, in clothes which are used for small children wherein the term "small children" is intended to include babies and infants, entire front and rear bodies of top clothes, bottom clothes or clothes consisting of the top clothes and the bottom clothes continuous therewith are continuously formed of elastic knitted fabric comprising elastic thread knitted by a knitting machine; and thread of a required part of the clothes is knitted by a different method to differentiate expansiveness of the required part from that of other parts of the clothes.

Because the clothes is formed of the expansive knitted fabric comprising the elastic thread, the knitted fabric is more expansive than the fabric knitted by the conventional knitting method and can be restored to the original shape than the knitted fabric by the conventional knitting method. Thus, the knitted fabric expands about 10 cm in the periphery of a baby's chest, belly, and waist. Normally, the baby becomes taller by about 10 cm in the interval between the first growth stage and the second growth stage and between the second growth stage and the third growth stage, respectively. Therefore, the preparation of clothes of three different sizes each suitable for one of the three growth stages (see FIGS. 1A, 1B, and 1C) is sufficient for babies and infants until throughout the whole infantile period of time. The baby of the first through third stages grows faster than any other period of time throughout life in the height, the circumference of the chest, belly, and waist. Because the clothes are elastic about 10 cm lengthwise and widthwise, they can fit to respective parts of the baby's body without obstructing the baby's actional function and without forming a gap between the clothes and the skin. Further, because the knitted fabric is constituted of the elastic thread, the fabric is restored to its original shape after washing the clothes and thus the shape thereof lasts for a longer time than the conventional clothes consisting of 100 percent cotton.

Infants and babies grow quickly but all parts of their body do not grow uniformly, but the growth speeds of respective parts are different according to respective growth stages. Thus, depending on each growth stage of a baby, the clothes of the present invention are formed in such a manner that a part of the clothes corresponding to a part of the baby's body which grows faster than any other part thereof is more expansive than any other part of the clothes. Further, because the actional characteristic of the baby is different according to each growth stage, a required part of the clothes is greatly expansive according to each growth stage so that the clothes obstruct the motion function but accelerates it.

In addition, because the entire front body and rear is formed of the fabric continuously knitted by a knitting machine, the clothes having a small number of sewing parts can be provided, thus not stimulating the skin much. Accordingly, the baby's soft skin is not roughened.

In the clothes for babies, the thread of the belly part of the front body is knitted by a different method to bulge the belly part thereof to wrap a baby's belly three-dimensionally and allow the belly part to be more expansive than other parts of the clothes.

Because the thread of a part corresponding to the belly part is knitted by a different method to bulge the belly part to wrap the baby's belly three-dimensionally and the belly part is allowed to be more expansive than other parts of the clothes, the clothes can fit to the baby's body, thus allowing the baby having a bulged belly to wear the clothes comfortably. The bulged degree of the belly of a baby aged 0–3 months is highest. Thus, if the belly part of the clothes has the same structure as those of other parts thereof, the clothes are tight for the baby, thus making the baby feel uncomfortable. The clothes having the above-described structure solves the disadvantage.

Preferably, the knitted fabric comprises the elastic thread knitted cylindrically by a circular knitting machine such that the front body of the fabric and the rear body thereof are continuous with each other. This structure allows the clothes to have a reduced number of sewing parts, thus stimulating the baby's skin in a small extent. Further, the structure facilitates a sewing operation and reduces the number of clothes-manufacturing processes, thus enhancing productivity. When clothes are of front-open type, the cylindrical fabric is cut axially to form the clothes.

The elastic thread has a multi-layer structure formed of polyurethane elastic thread and cotton thread covering the polyurethane elastic thread. The knitted fabric is knitted by the elastic thread of the multi-layer and 100% cotton thread. An outer thread of the knitted fabric consists of the polyurethane elastic thread preferably. An inner thread of the knitted fabric consists of the cotton thread preferably. More specifically, "CORE SPAN YARN" (registered trade mark) is used for the elastic thread having the multi-layer structure. The "CORE SPAN YARN" consists of spandex thread formed of 3 wt % of polyurethane and 97 wt % of cotton, and 100 percent cotton covering the peripheral surface of the spandex thread.

The thread can be elastic when it comprises elastic synthesized fiber. Because the thread having the multi-layer structure comprise 100 percent cotton covering the peripheral surface of the synthesized fiber, the cotton contacts the skin softly. Needless to say, the elastic thread is not limited to thread having the multi-layer structure, but thread stimulating the skin at a small extent can be used.

Preferably, the knitted fabric is formed basically by rib knitting method of float stitch or of tuck stitch; and thread of the belly part of the fabric is knitted by plain stitch to allow the belly part to be more expansive lengthwise and widthwise than other parts of the fabric.

Because the belly part of the fabric is formed in the shape of a circle or an ellipse and the thread thereof is formed not by the rib knitting method but by plain stitch to bulge the belly part and expand it lengthwise and widthwise, the belly part can wrap the baby's belly according to a bulged degree thereof and does not make the baby feel tight, but comfortable.

A sleeve comprising the knitted fabric using the elastic thread is sewn to the top clothes or the clothes consisting of the top clothes and the bottom clothes continuous therewith. The thread of the sleeve is knitted by plain stitch to expand the sleeve lengthwise and widthwise. An open end of the sleeve is formed of powerful elastic thread knitted by braid-over-braid knitting method and not sewn.

Because the open end of the sleeve consists of powerful elastic thread, the end of the sleeve can fit to the arm, thus not obstructing the baby's actional function. Further, because the thread of the sleeve is elastic and knitted by plain stitch, the sleeve can follow the motion of the arm, thus not obstructing the baby's function. In addition, because the thread of the open end of the sleeve is knitted by braid-over-braid knitting method, the open end of the sleeve is not required to be sewn, thus stimulating the arm at a small extent. Needless to say, the length of the sleeve can be selected as desired. For example, a half-sleeve, a long sleeve or no-sleeve can be selected.

The thread of an upper part of a back side of at least the top clothes and the clothes consisting of the top clothes and the bottom clothes continuous therewith are knitted by pile stitch so that the upper part of the back side of the top clothes have a high degree of perspiration-absorbing performance and air permeability.

More specifically, apart corresponding to the region from an intermediate portion of the back of the rear body to the upper end thereof corresponding to the periphery of the neck is formed of thread knitted by pile stitch. Because there is much space between the baby's neck and the upper part of the front body corresponding to the periphery of the neck, the upper front part of the clothes in the periphery of the neck is not formed of thread knitted by the pile stitch, but may be knitted by the pile stitch so that the part has a high degree of perspiration-absorbing performance and air permeability.

Babies sweat about twice as much as adults and in the maximum amount, especially on the upper part of the back. Thus, it is preferable to form the upper part of the back thread knitted by the pile stitch so that the upper part of the back has a high degree of perspiration absorbing performance and air permeability. Because the baby aged 0–three or four months is always lying in the bed, the baby sweats much and gets wet in summer when it is hot and stuffy. Thus, it is effective to allow the upper part of the back to have a high degree of perspiration-absorbing performance and air permeability.

The shape of the clothes in the periphery of the neck is selected according to whether it is easy or not to put the clothes on the baby and unclothe them; the shape of the baby's body such as the size of its head; and its actional characteristic. Clothes which are put on the baby downward from the head is not preferable for the baby of the first growth stage, namely, the baby aged 0–four months (see FIG. 1A) because the baby cannot support its neck by itself and has a big head. Thus, it is preferable to overlap the right and left parts with each other in the shape of V in the upper front part of the clothes by greatly spacing around the baby's neck. Clothes which are put on the baby downward from the head is more favorable than clothes of the front overlapping type for the baby of the second growth stage, namely, the baby aged about three months–about eight months (see FIG. 1B), because the baby can support its neck by itself and becomes active. But the baby of this growth stage still has a big head. Thus, clothes of cross shoulder type is most favorable, because it is easy to form a large space in the periphery of the neck in the case of the clothes of cross shoulder type and thus easy to put the clothes on the baby and unclothe them.

The baby of the third growth stage, namely, the baby aged about six months–about 15 months (see FIG. 10) is more active and many babies of this growth stage do not like to have clothes put on downward from the head. Thus, it is preferable to attach grippers to one shoulder part of clothes or both shoulder parts thereof.

A crotch part of the bottom clothes or that of the clothes consisting of a top portion and a bottom portion continuous therewith is of a diaper cover type. That is, fabric positioned at a front side and fabric positioned at a rear side are folded at the front side. Snaps are attached to both ends of the fabric at the front and the rear side fabric, and removably fixed to snaps. The knitted fabric of the crotch part is formed of the thread knitted by tammy stitch of a kind of float stitch or tuck stitch to allow the crotch to be expansive in a small degree so that a diaper is prevented from being dislocated.

The clothes which are worn by the baby of the first growth stage (see FIG. 1A) are mostly clothes of romper type, namely, clothes consisting of a top and bottom portion continuous therewith. The clothes of the romper type are frequently worn by the baby of the second and third growth stages (see FIGS. 1B and 1C) although the top clothes and the bottom clothes are worn thereby. In the clothes of the romper type and the bottom clothes, the crotch part is of diaper type. That is, the lower portion of the rear body is folded upward and removably fixed to an upper part thereof with a snap attached to the lower end of the rear body and lower end of the front body. Because the weight of a diaper and urine is applied to the crotch part, the crotch part is formed of thread knitted by tammy stitch to allow it to be expansive in a small degree. Therefore, the crotch part can be prevented from slipping down.

The position of the snap is varied according to the growth stages of the baby. That is, in the clothes which are worn by the baby of the second growth stage, the lower portion of the crotch part is folded in a considerably large amount upward to the vicinity of the lower end of the belly part, and the position of the snap is upwardly to allows the diaper to be replaced easily.

Considering that the baby of the third growth stage lies on its face on the bed for a long time, the position of snap is lower than that of the second growth stage.

Because the buttocks of the baby of the second and third growth stages grow, the belly part of the bottom cloth and the continuous cloth are bulged to allow the belly part to be three-dimensional and consists of thread knitted by plain stitch so that the belly part is expansive lengthwise and widthwise. The clothes having this structure can fit to the baby's belly in conformity to the growth of the buttocks.

The lower end of the top clothes is formed of powerful elastic thread knitted by braid-over-braid knitting method and not sewn. That is, instead of romper type, the top clothes of undershirt type, namely, the top clothes whose lower end is open can be used for the baby of the first growth stage (see FIG. 1A) to omit snap-connecting and snap-disconnecting works required in the case of clothes of the romper type having the crotch part. The baby of the second and third growth stages and infants often wear the top clothes and the bottom clothes. In this case, the lower end of the top clothes consisting of powerful elastic thread can fit to the body. Considering that the baby of the second and third growth stages and infants become active and thus the upper part of their bodies are apt to be bare, the top clothes having the structure above-described fits to the body, thus preventing the upper part of their bodies from being bare. Further, because the thread of the lower end of the top clothes is knitted by the braid-over-braid knitting method, the clothes has a small number of sewing parts, thus stimulating the skin in a small extent and reducing the number of sewing processes. Needless to say, it is possible to fold the lower end of the top clothes and sew the folded portion.

A waist part of the bottom clothes positioned at an upper end thereof is formed of powerful elastic thread knitted by braid-over-braid knitting method and not sewn. The waist part of the bottom clothes formed of powerful elastic thread can fit to the baby's waist and held at an appropriate force by the baby's waist. Further, because rubber is not used at the waist part, the baby's waist is not tight. In addition, the waist part is not sewn, the skin of the waist is not stimulated much. It is possible to knit the upper part of the bottom clothes, namely, the region from the waist to the belly part thereof by the braid-over-braid knitting method, using powerful elastic thread so that the upper part of the bottom clothes serves as a belly band.

When the bottom clothes are of panty type, a part thereof corresponding to the base of each of right and left thighs is formed of powerful elastic thread knitted by braid-over-braid knitting method and not sewn.

It is preferable that the panty for the baby of the second growth stage (see FIG. 1B) is of brief type in consideration of the actional characteristic of the baby of this growth stage. In this case, it is preferable that the thread of the part, corresponding to open ends of the baby's right and left legs are not knitted by the braid-over-braid knitting method but piping is attached.

For the bottom clothes of the baby of the third stage (see FIG. 1C), it is preferable that the panty is of trunks type, i.e., that panty is shaped to wrap up a diaper cover and that the open ends of the trunks are formed at a position corresponding to the base of the baby's thigh. The thread of the open ends are knitted by the braid-over-braid knitting method, using powerful elastic thread to fit the baby's thigh. Because the skin of the base of the baby's thigh is weak, the open ends of the trunks is not sewn to reduce the degree of stimulus to be applied to the skin.

When the bottom clothes are of trousers type, a part of the bottom clothes corresponding to a knee of each of right and left legs is formed of thread knitted by plain stitch to allow the part of the bottom clothes to be more expansive lengthwise and widthwise than other parts; and a periphery of the part is formed of thread knitted by float-mesh stitch to allow the part to be expansive in a small degree. Because the parts of the bottom clothes corresponding to knees of the right and left legs are expansive lengthwise and widthwise, the actional function of the baby is not obstructed. Because the periphery of the parts is expansive in a small degree, the knee part of the bottom clothes can be prevented from getting out of shape.

When the bottom clothes are of trousers type, a part of the bottom clothes corresponding to a region from a knee to the lower end of each of right and left legs is formed by plain stitch so that the part of the bottom clothes is elastic lengthwise and widthwise. The trousers of the above-described part having this structure can follow the active motion of the legs.

Preferably, the lower end of each of the right and left leg parts is formed of powerful elastic thread knitted by braid-over-braid knitting method and not sewn. The trousers having this structure allows the lower ends of the right and left leg parts thereof to fit to the lower part of the baby's leg and allows the baby to move easily and accelerating the actional function of the baby's legs. Further, the lower end the leg parts fit to any portion of the baby's legs at an appropriate force. When the leg parts are long for the baby's legs, the lower ends of the leg parts are capable of fitting to the baby's legs at an appropriate force, thus preventing the baby from falling down by treading on the bottom of the trousers when it crawls or walks.

The top clothes, the bottom clothes or the continuous clothes consists of an underwear. Because the baby of the first growth stage lies in bed almost all of the day, the main clothes of the baby are underwear. The baby of the second and third growth stages and infants spend more time outdoors. Thus, it is preferable that clothes for them have colors and designs so they can be used as outdoor clothes.

BRIEF DESCRIPTION OF DRAWINGS

These and other objects and features of the present invention will become clear from the following description taken in conjunction with the preferred embodiments thereof with reference to the accompanying drawings throughout which like parts are designated by like reference numerals, and in which.

BEST MODE FOR CARRYING OUT THE INVENTION

Clothes which are used as underwear will described below in each growth stage of a baby.

Figure 1:
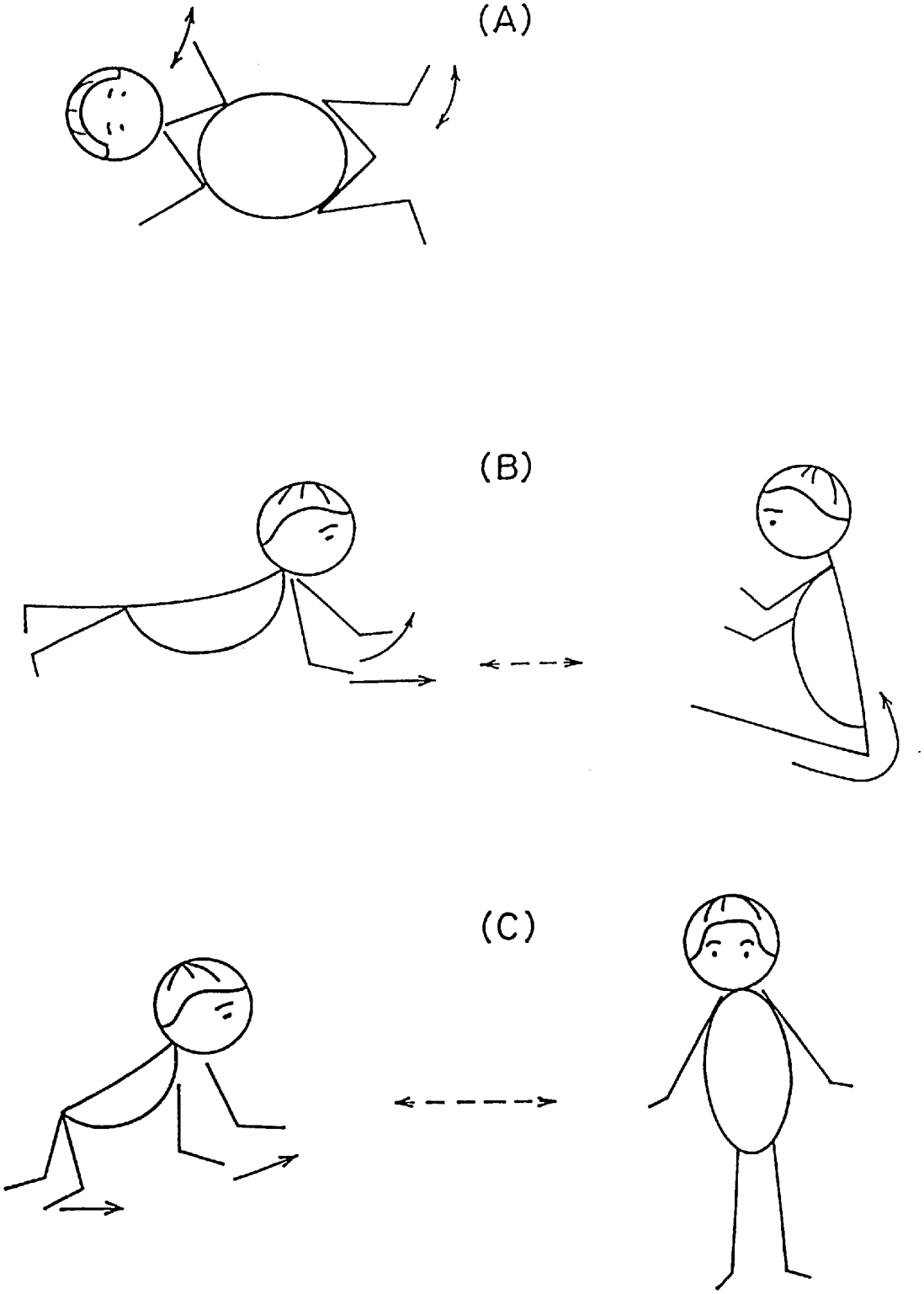
FIGS. 1A, 1B, and 1C are schematic views showing actional characteristics in each growth stage of babies.

FIGS. 2A, 2B through FIGS. 5A, 5B show underwear, according to the first embodiment, for babies aged zero–three months shown in FIG. 1A, namely, babies of the first growth stage.

Figure 6:
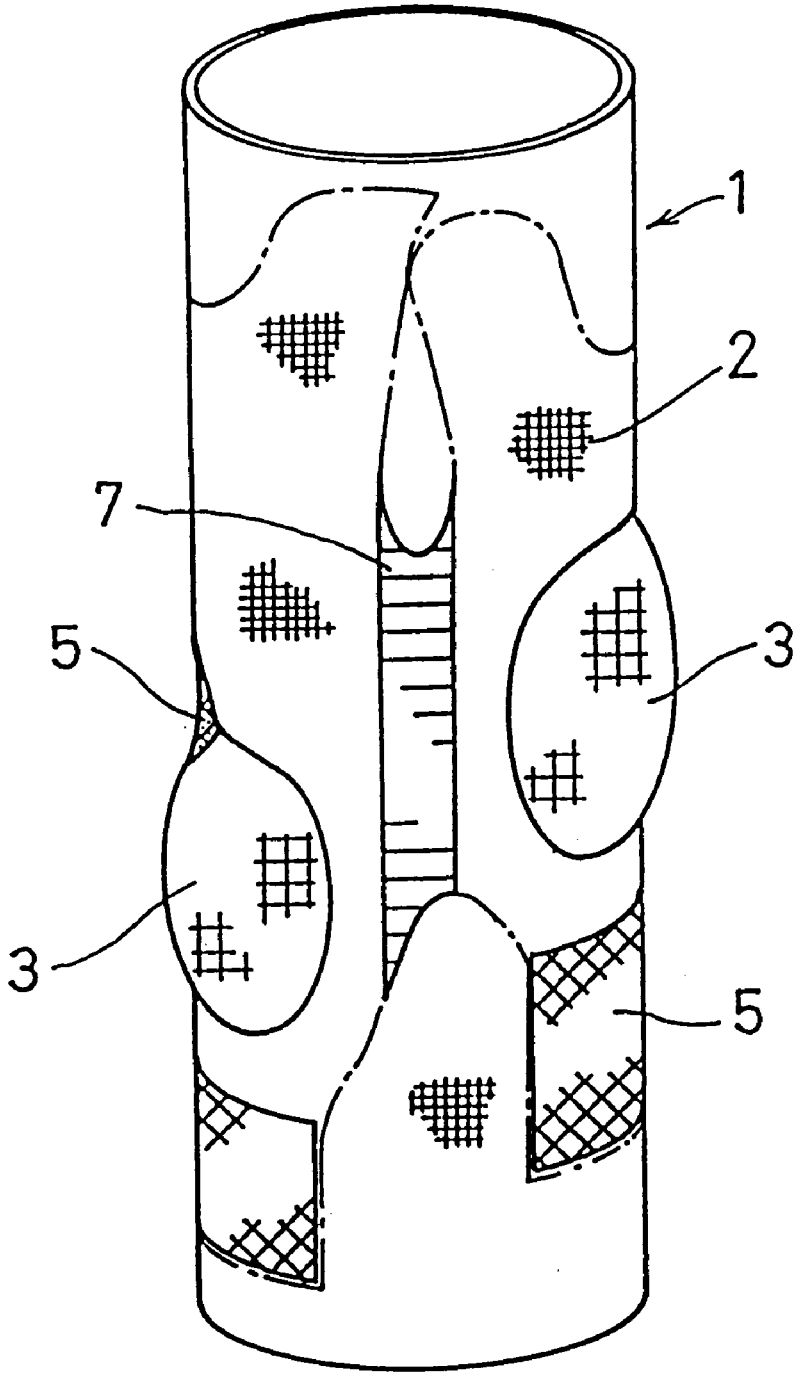
FIG. 6 is a schematic perspective view showing cylindrical knitted fabric formed by continuously knitting thread.

As shown in FIG. 6, underwear of the first through third embodiments and modifications thereof are formed of a cylindrical continuous knitted fabric 1 formed by a shaping circular knitting machine. The shaping circular knitting machine has a function of knitting thread partly by a different method to form a desired knitted structure and to form three-dimensional knitted fabric having a bulged part at each desired part.

Figure 7:
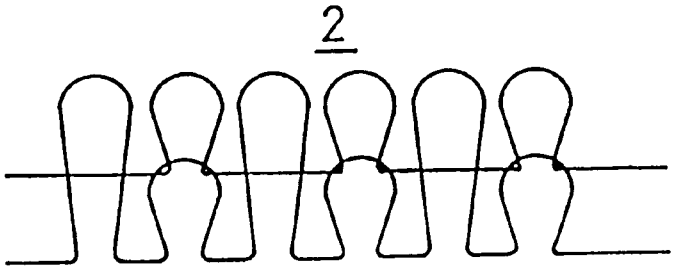
FIG. 7 is a schematic view showing rib stitch.
Figure 8:
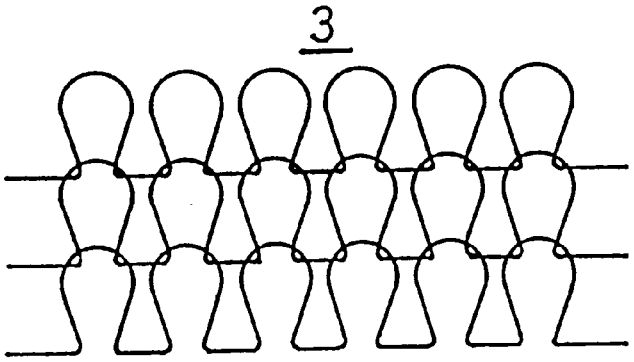
FIG. 8 is a schematic view showing plain stitch.
Figure 9:
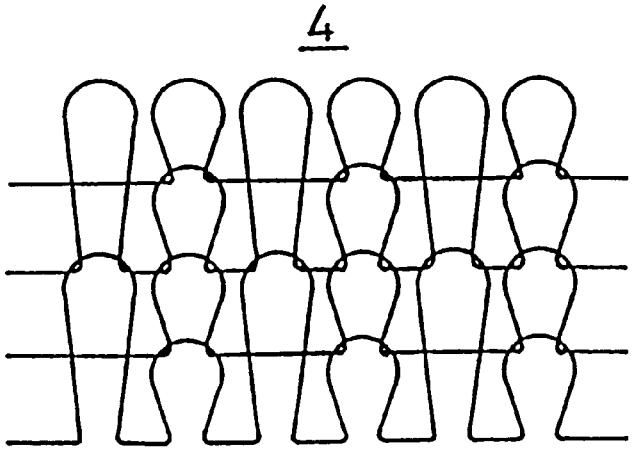
FIG. 9 is a schematic view showing pile stitch method.
Figure 10:
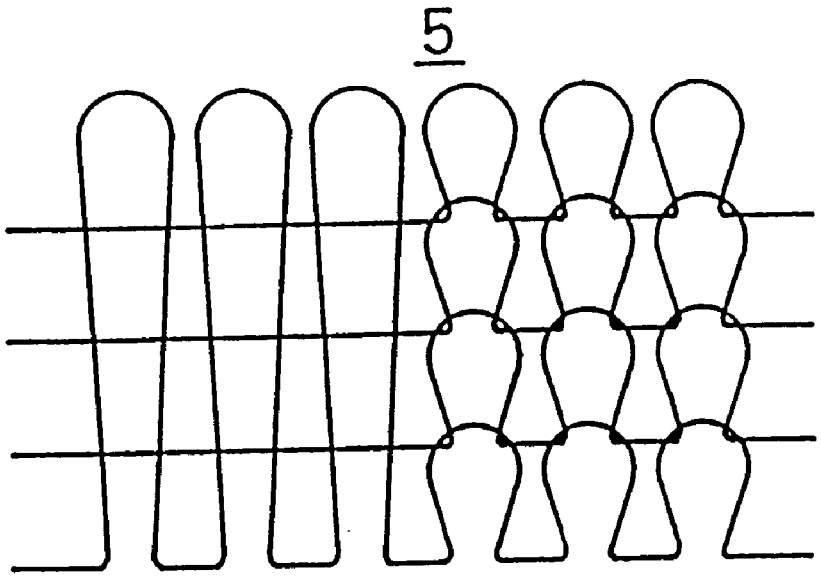
FIG. 10 is a schematic view showing tammy stitch.
Figure 11:
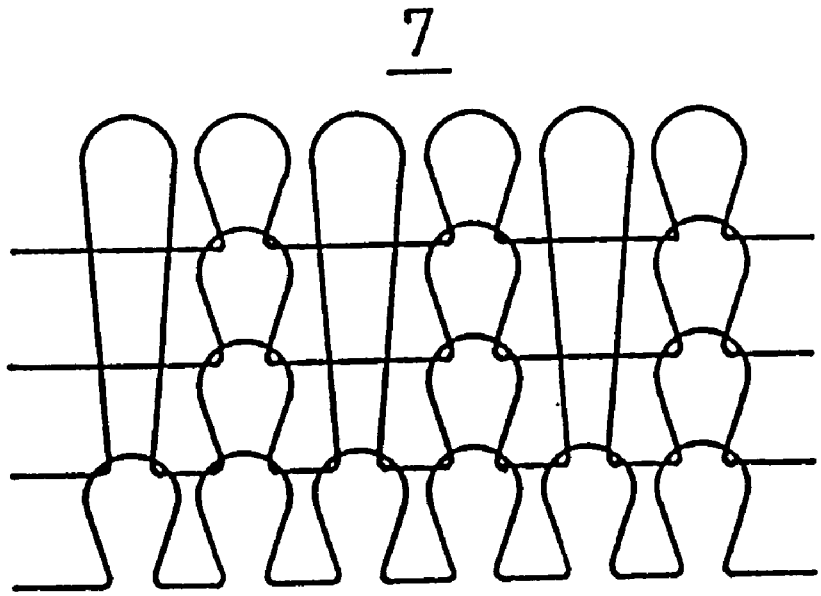
FIG. 11 is a schematic view showing lengthwise expansion rib stitch.
Figure 12:
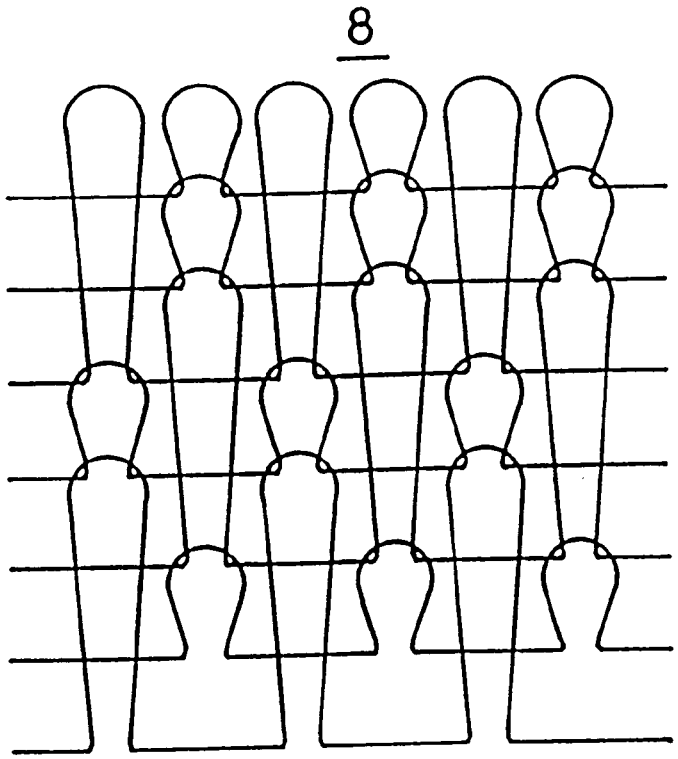
FIG. 12 is a schematic view showing mesh stitch.

That is, in the description which will be made later about an underwear of each embodiment, basically, the continuous cylindrical knitted fabric 1 is formed by rib stitch 2 of a kind of float stitch, as shown in FIG. 7. But the continuous cylindrical knitted fabric 1 may be formed by the rib stitch 2 of a kind of tuck stitch. In order to allow required parts of each underwear to be elastic lengthwise and widthwise at required rates, the thread is knitted by plain stitch 3 (shown in FIG. 8) by which a required part is allowed to be greatly elastic lengthwise and widthwise; pile stitch 4 (shown in FIG. 9) by which a required part is allowed to have a high degree of perspiration-absorbing property and permeability; tammy stitch 5 (shown in FIG. 10) of the float stitch by which a required part is allowed to be elastic in a small extent; lengthwise elastic rib stitch 7 (shown in FIG. 11) of a kind of float stitch by which a required part is allowed to be elastic greatly lengthwise; mesh stitch 8 (shown in FIG. 12) of a kind of float stitch by which a required part is allowed to be hardly elastic; and braid-over-braid knitting method 6 (knit-in, shown in FIG. 7) consisting of the rib stitch 2. The float stitch may be replaced with the tuck stitch. The underwear of each embodiment is not provided with all the structures knitted by the above-described stitch 2 through 8.

Figure 13:
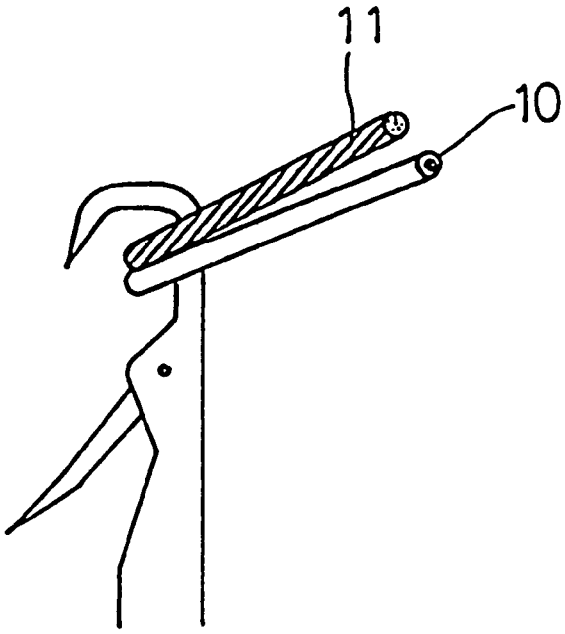
FIG. 13 is a schematic view showing thread which is used in the clothes of the present invention.

As shown in FIG. 13, the thread which is used to form the knitted structures consists of an elastic thread 10 which is used as the lower layer thereof and a cotton thread 11 which is used as the upper layer thereof. The entire fabric can be expanded by 10 cm lengthwise and widthwise because it comprises the elastic thread 10.

As the elastic thread 10, elastic thread having a laminar structure consisting of polyurethane elastic fiber and cotton covering the polyurethane elastic fiber is used. More specifically, the elastic thread 10 in the name of "CORE SPAN YARN" (registered trade mark) is used. The elastic thread 10 consists of spandex thread formed of three wt % of polyurethane and 97 wt % of cotton and 100 percent cotton covering the peripheral surface of the spandex thread. Thus, the elastic thread 10 used as the inner side is covered with the cotton which is natural fiber, only the cotton contacts skin. Thus, the skin is stimulated at a low degree.

Figure 2:
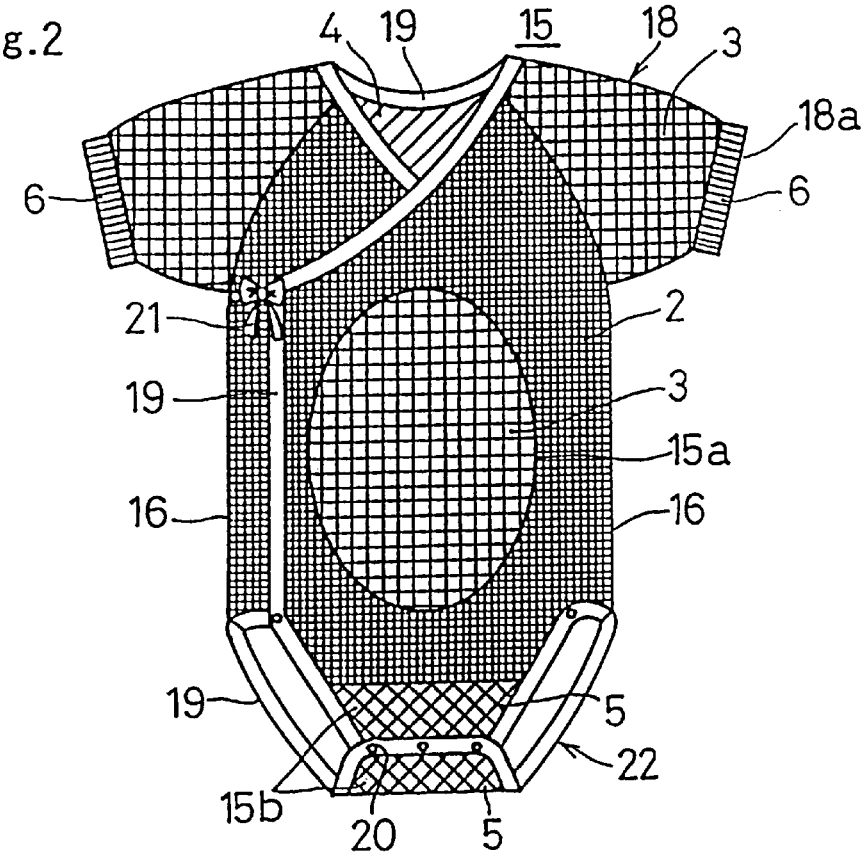
FIG. 2A is a front view showing an underwear of a first embodiment in which respective parts are hatched in different manners according to different knitted structures.
FIG. 2B is a rear view showing an underwear of a first embodiment in which respective parts are hatched in different manners according to different knitted structures.
Figure 2:
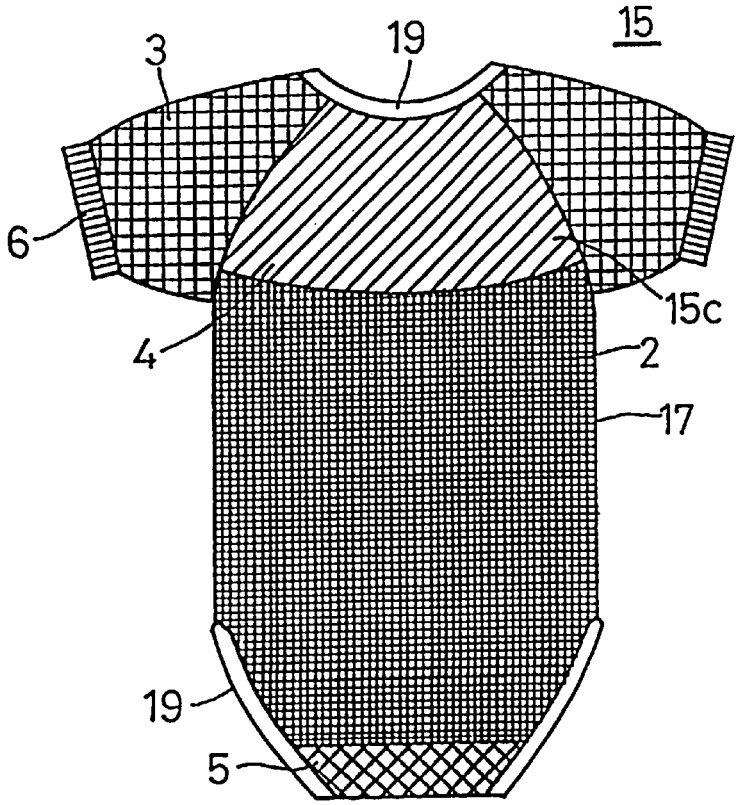
Figure 3:
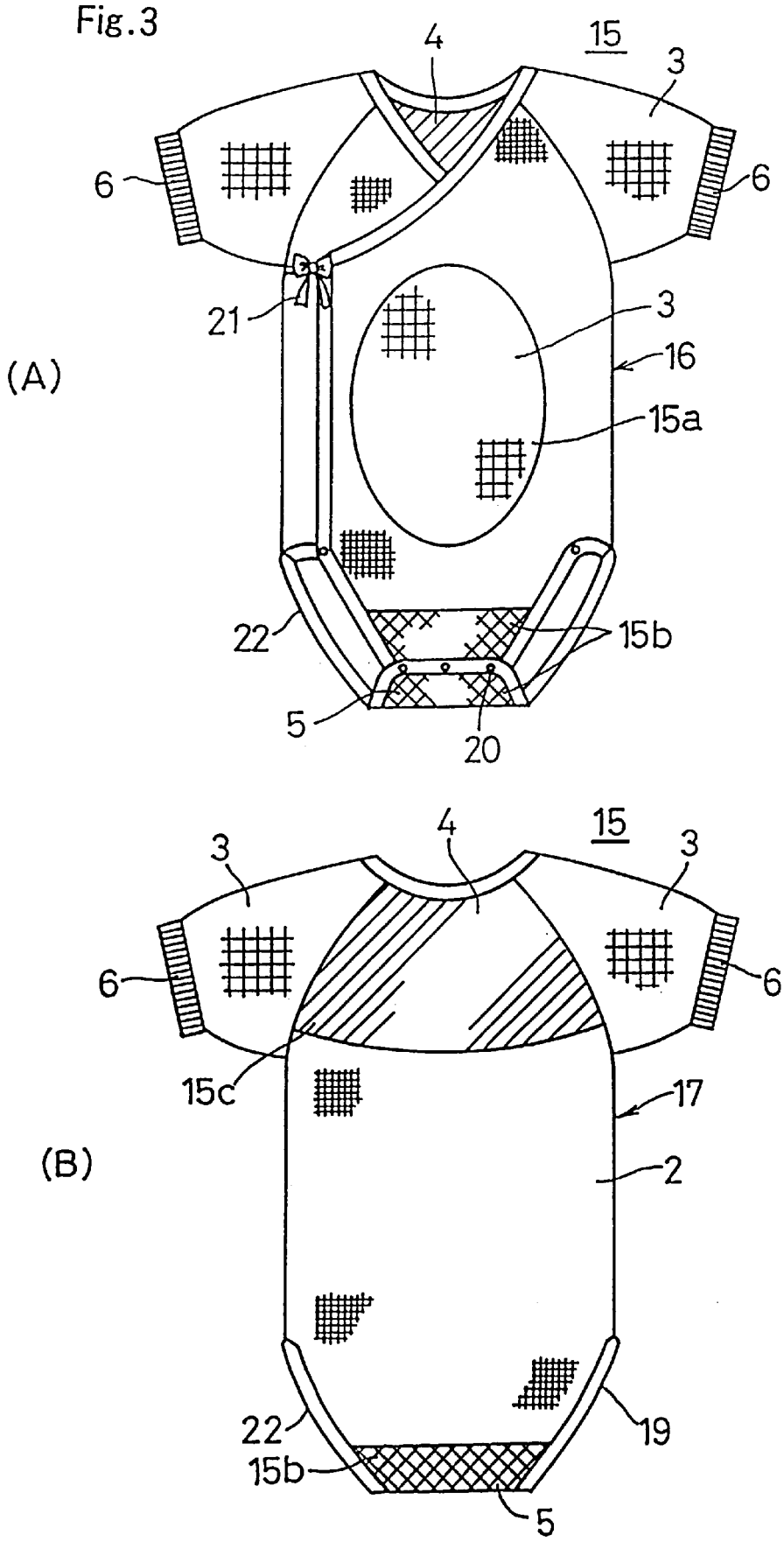
FIGS. 3A and 3B are front view showing the underwear, shown in FIG. 2, in which the respective parts are hatched partly.
Figure 4:
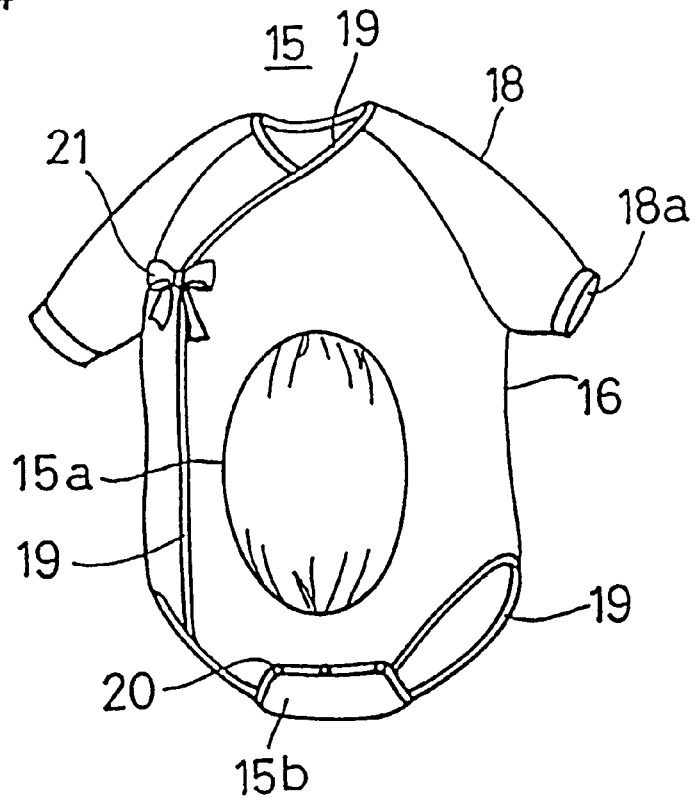
FIG. 4A is a perspective view, showing the underwear of the first embodiment, looked from the front side.
FIG. 4B is a perspective view, showing the underwear of the first embodiment, looked from the rear side.
Figure 4:
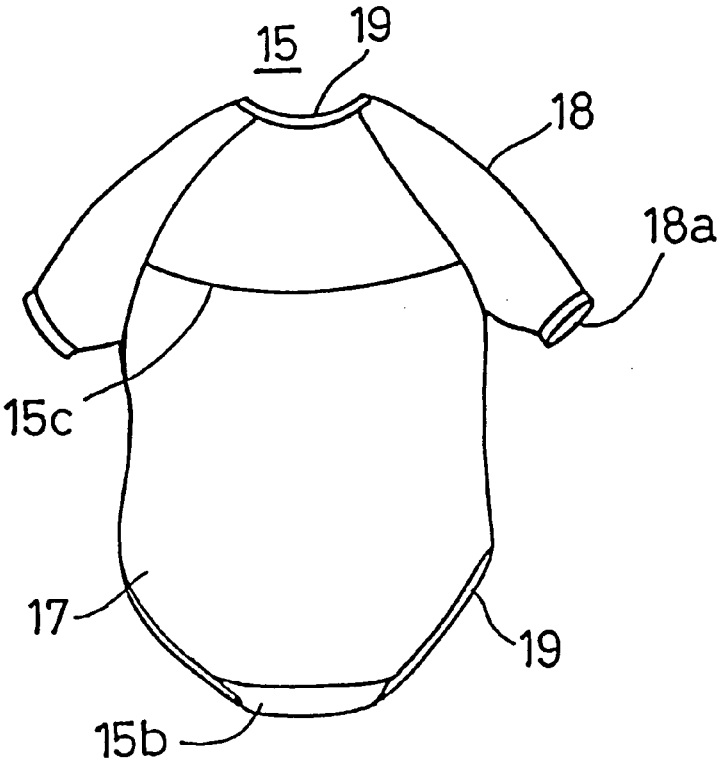

In FIGS. 2A, 2B through FIGS. 4A, 4B showing a romper type underwear 15 for a baby of the first growth stage, the underwear 15 shown in FIGS. 2A and 2B are hatched according to the knitted structures, whereas the underwear 15 shown in FIG. 3 is hatched partly according to the knitted structures. In the second and third embodiments, underwear are hatched partly similarly to the underwear of FIGS. 3A and 3B.

Figure 14:
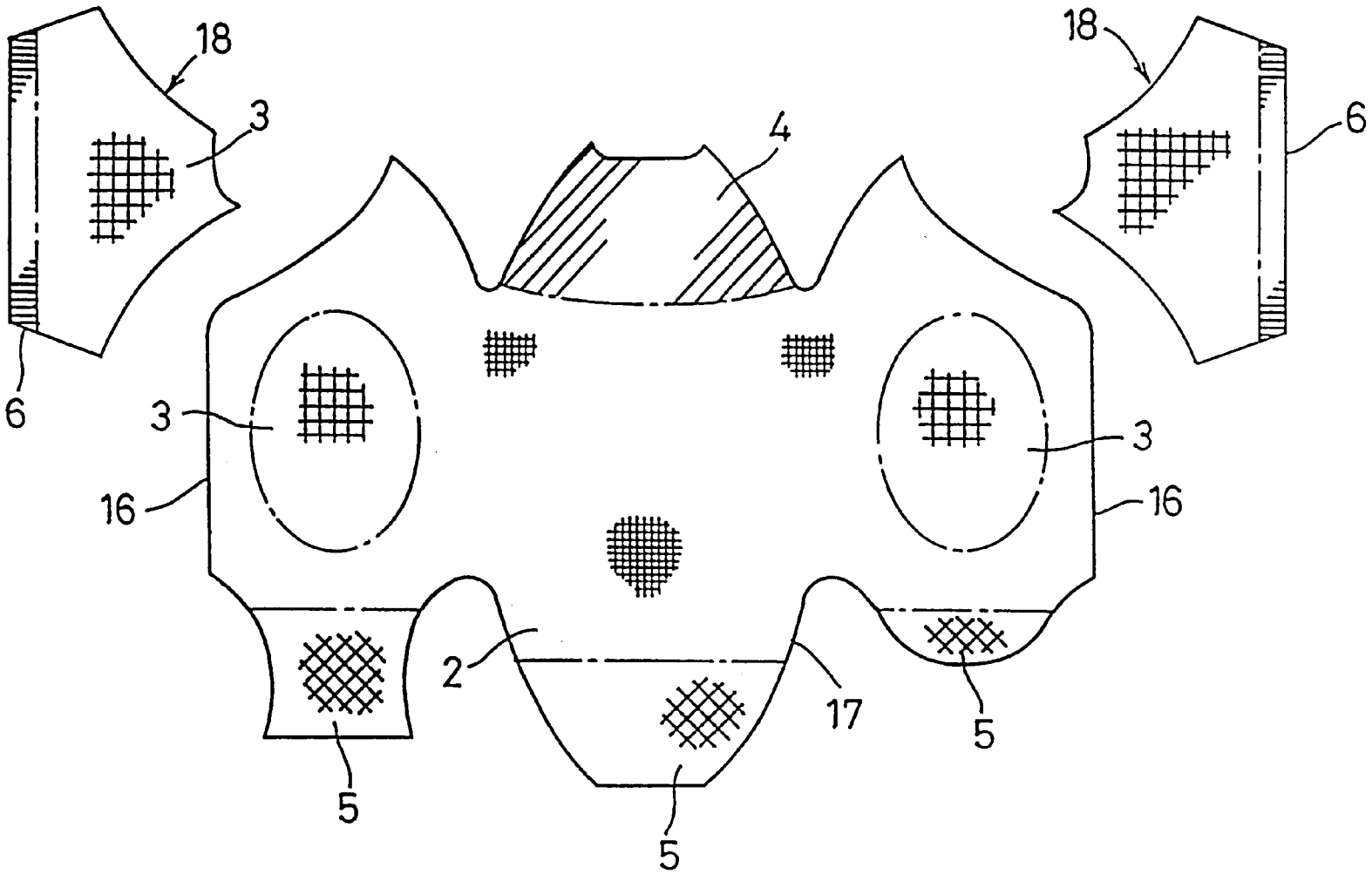
FIG. 14 is a view showing a cut pattern of the first embodiment.

The underwear 15 of the first growth stage is of forward overlapping type. That is, a cylindrical continuous fabric (shown in FIG. 6) is cut axially to form a continuous fabric consisting of a rear body 17 and a front body 16 having a right half and a left half, as shown in FIG. 14. FIG. 6 shows the knitted fabric of not for babies of the first growth stage but those of the second growth stage which will be described later.

Right and left sleeves 18 are constituted of each of cylindrical knitted fabrics formed separately by knitting thread by a circular knitting machine. An edge of the sleeve 18 is sewn to the raglan type-shoulder part formed of the front body 16 and the rear body 17. Then, piping 19 is formed at the edge of the part which is positioned in the periphery of the baby's neck and is V-shaped as a result of overlapping the right and left halves of the front body 16 with each other; the edge of the right half of the front body 16 and that of the left half thereof; the edge of the part corresponding to the upper end of each of the baby's legs; and the lower edge of the front and rear parts formed in the shape of a diaper cover. A snap 20 is mounted on the lower edge of the front and rear parts formed in the shape of a diaper cover. A tying cord 21 is installed on each of the right and left halves of the front body 16 to connect both when both are overlapped forward with each other.

In the underwear 15 of the romper type, the thread of an elliptic part 15*a* corresponding to the belly is knitted by plain stitch 3 so that the part 15*a* is elastic greatly lengthwise and widthwise and bulged forward. The thread of a part 15*b* corresponding to the crotch and opened and closed by means of the snap 20 is knitted by tammy stitch 5 so that the part 15*b* is elastic in a small extent. The thread of a part 15*c* corresponding to the region from an upper portion of the spine to the neck is knitted by the pile stitch 4 so that the part 1*c* has a high degree of perspiration-absorbing performance and air permeability. The thread of the remaining part of the front body 16 and the rear body 17 are knitted by the rib stitch 2. As described above, the knitted fabric forming the front body 16 and the rear body 17 continuously is formed by the four kinds of the stitch, namely, the rib stitch 2, the plain stitch 3, the pile stitch 4, and the tammy stitch 5.

The sleeve 18 is half-length to allow the baby's arm to be bare and formed of thread knitted by the plain stitch 3 so that the sleeve 18 is elastic lengthwise and widthwise, similarly to the belly part 15*a*. The thread of the sleeve band 18*a* is knitted by brain-over-braid knitting method 6 and is not sewn to the sleeve 18. The sleeve band 18*a* is formed of the powerful elastic thread 10 (see FIG. 13) so that the sleeve band 8*a* fits to the periphery of the arm.

The baby's legs are approximately M-shaped. Thus, a part 22 corresponding to the both open ends of the right and left legs is so shaped that the baby projects its legs sideways and bends and stretches them easily.

In the romper type-underwear 15 (see FIGS. 2 and 4), for the baby of the first growth stage, having the above-described structure, the belly part 15*a* is bulged forward and formed by the plain stitch 3 so that the belly part 15*a* has a great elasticity, because the baby of the first growth stage has a belly bulged forward to an extent greater than any other growth stage thereof. Thus, the belly part 15*a* covers the belly bulged forward and fits to the belly. It is not preferable to press the belly because the baby of the first growth stage breathes air by abdominal respiration. The belly part 15*a* having the structure of the first embodiment prevents the belly from being pressed.

Considering that the baby of the first stage sweats a great amount at the upper part of the back thereof in particular and is always lying in the bed and thus gets wet, the thread of the part 15*c* having a high degree of perspiration-absorbing performance and air permeability is knitted by the pile stitch. Thus, the part 15*c* absorbs the sweat of the baby to a great extent, thus preventing the baby from being wet. Further, considering that a load of a diaper, a diaper cover, and urine is applied to the crotch part 15*b*, the crotch part 15*b* can be prevented from expanding or dislocating, because as described previously, the thread of the crotch part 15*b* is knitted by the tammy stitch 5 so that the crotch part 15*b* is elastic in a small degree.

Further, because the thread of the first embodiment comprises the elastic thread, it elongates more than the fabric formed by the conventional knitting method. The remaining parts of the front body 16 and the rear body 17 are formed of thread knitted by the rib stitch 2 to elongate the thread about 10 cm lengthwise and widthwise. Thus, because of the expansion of the thread and the three-dimensional knitting, the underwear can be used although the baby grows bigger very fast.

Because the underwear 15 is of the forward overlapping type, the underwear 15 can be easily put on the baby lying in the bed and incapable of supporting its neck by itself and removed therefrom easily. Further, because the string 21 is attached to the front portion of the underwear 15, the belly and other parts of the baby's body can be prevented from being bare.

The baby vomits milk or mother's milk and evacuates loose feces several times a day, the underwear 15 gets dirty fast. Thus, the underwear 15 is required to be washed frequently. Because the underwear 15 is composed of the fabric containing the elastic thread 10, the underwear 15 is returned to the original shape after washing it. Therefore, the shape of the underwear 15 can be kept for a long time.

Considering that the baby's skin is delicate and thus not resistant to stimulus, the underwear 15 is composed of the front body 16 and the rear body 17 integral therewith to reduce the number of sewing parts. Thus, the underwear 15 does not stimulate the baby much. In addition, in order to prevent the baby from being stimulated much, the inner side of the underwear 15 is composed of the elastic thread 10 comprising the multi-layer thread covering by cotton thread and outer side of the underwear 15 is composed the cotton thread 11 so that the cotton contacts the baby's skin.

Figure 5:
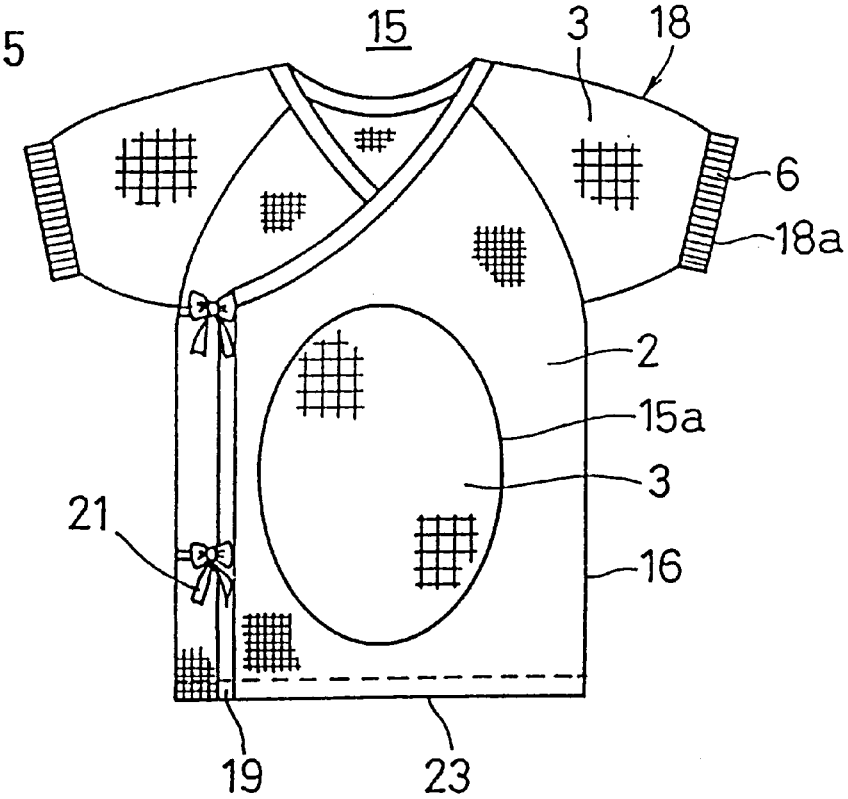
FIG. 5A is a front view showing a modification of the first embodiment.
FIG. 5B is a rear view showing the modification of the first embodiment.
Figure 5:
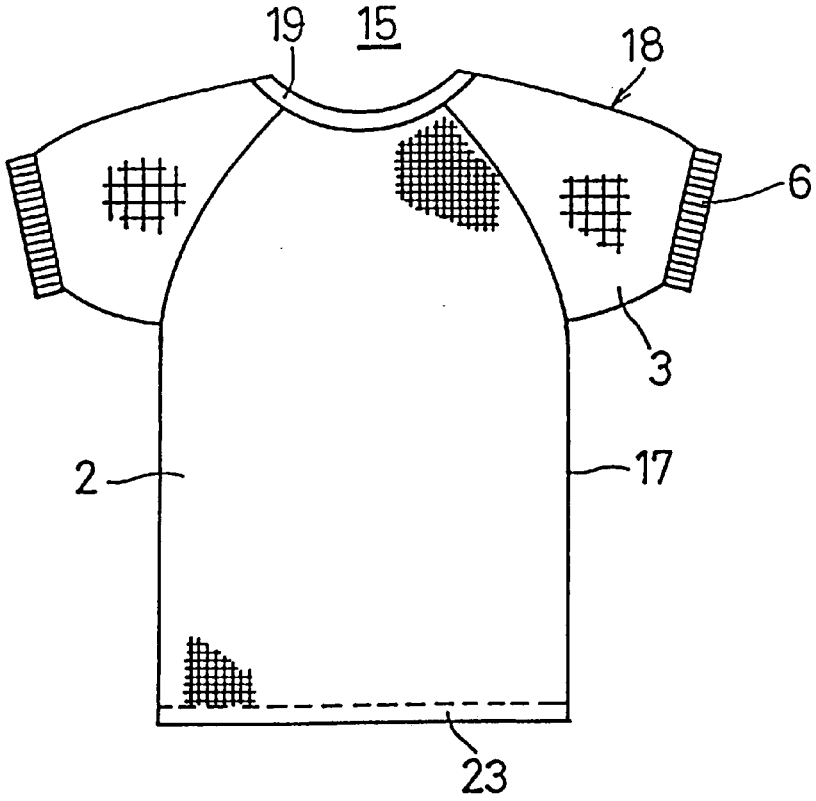

FIG. 5 shows a modification of the first embodiment. The top underwear 15 shown in FIG. 5 is not of the romper type, but its lower part extending below its crotch part is cut off to open the lower end 23. The lower end 23 of the top underwear 15 is folded and sewn, but instead, it is possible to treat the lower end 23 by the braid-over-braid knitting method 6 using powerful elastic thread, without sewing the lower end 23.

The underwear 15 of the modification is different from that of the first embodiment in that the part around the neck of the rear body 17 is not formed by the pile stitch 4. The reason is as follows: Because the lower end of the underwear 15 is open, air is more permeable in the underwear 15 of the former than in the underwear 15 of the latter. The structures of the other parts of the underwear 15 of the former are the same as those of the latter and thus the functions of the other parts of the former are the same as those of the latter. Thus, the descriptions of the other parts of the underwear 15 of the former are omitted herein. Needless to say, the part around the neck of the rear body 17 of the former can be formed by the pile stitch 4.

The underwear of the second embodiment is described below with reference to FIGS. 15A and 15B through FIGS. 18A and 18B. The second embodiment relates to the underwear which is worn by the baby of the second growth stage aged about three months–about eight months. As described previously, as the formative characteristic of the baby of the second growth stage, the buttocks grow outstandingly. Further, the baby becomes active. For example, the baby can turn in its bed and sit by itself. Accordingly, the sides of the clothes for the baby of the second growth stage are required to be elastic according to the baby's action, i.e., when the baby turns in its bed or raises its hand and in addition, the back and the crotch of the underwear are required to be elastic when the baby sits. Further, it is necessary to prevent the belly and other parts of the baby from being bare because the baby turns in its bed.

The underwear shown in FIGS. 15 through 18 are constructed in consideration of the above-described points. That is, different from the underwear 15 of the first embodiment, the underwear 15 of the second embodiment is not of the forward overlapping type, but is put on the baby downward from the head. Thus, the cylindrical continuous knitted fabric shown in FIG. 6 is used as it is to use it as the front body 16 and the rear body 17 integral with the front body 16. Similarly to the first embodiment, the sleeve 18 is sewn to the upper open edge of the front body 16 and the rear body 17.

An underwear 25 shown in FIGS. 15A, 15B, 16A, and 16B is of the romper type similar to that shown in FIG. 2. A top underwear of a modification of the second embodiment shown in FIGS. 17A and 17B is open at its lower end 23, similarly to that shown in FIG. 5. FIGS. 18A and 18B show a panty which is put on the baby as the bottom underwear and used in combination with the top underwear shown in FIGS. 17A and 17B.

Figure 15:
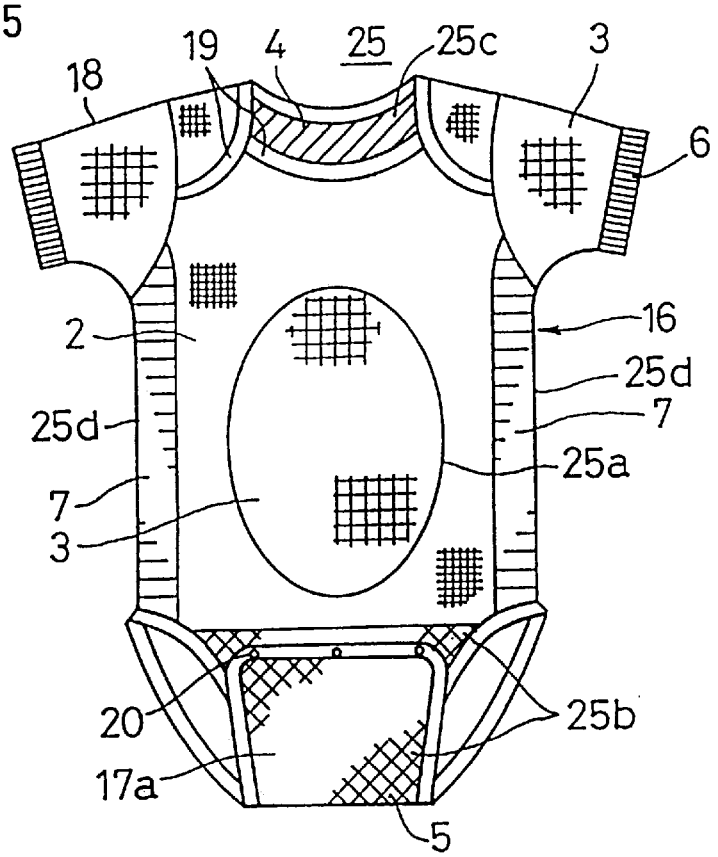
FIG. 15A is a front view showing an underwear of a second embodiment.
FIG. 15B is a rear view showing the underwear of the second embodiment.
Figure 15:
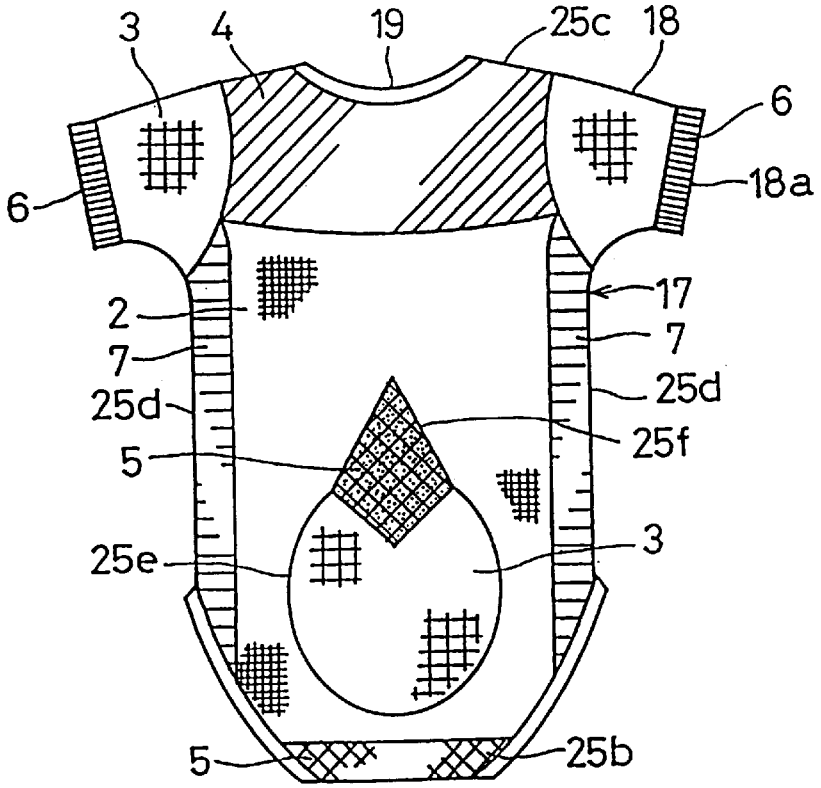
Figure 16:
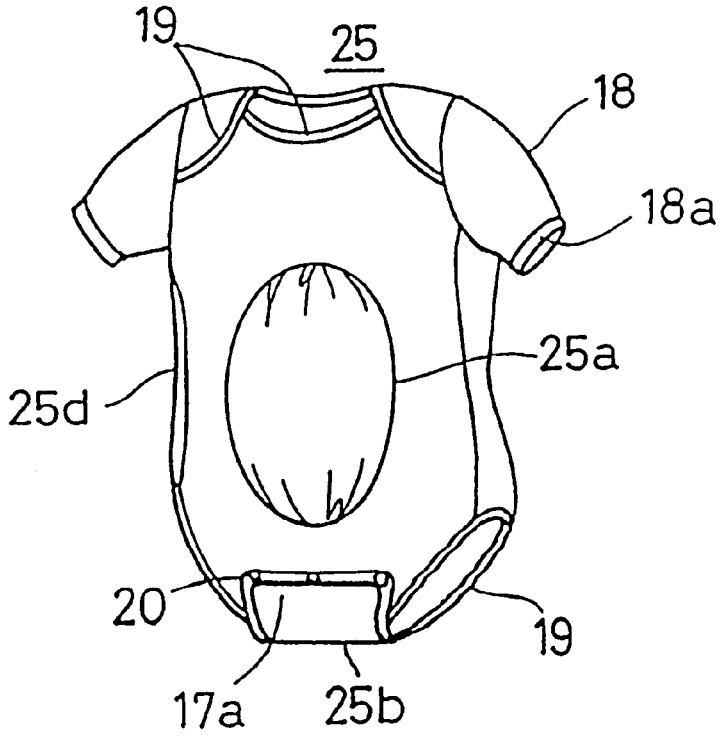
FIG. 16A is a perspective view, showing the underwear of the second embodiment, looked from the front side.
FIG. 16B is a perspective view, showing the underwear of the second embodiment, looked from the rear side.
Figure 16:
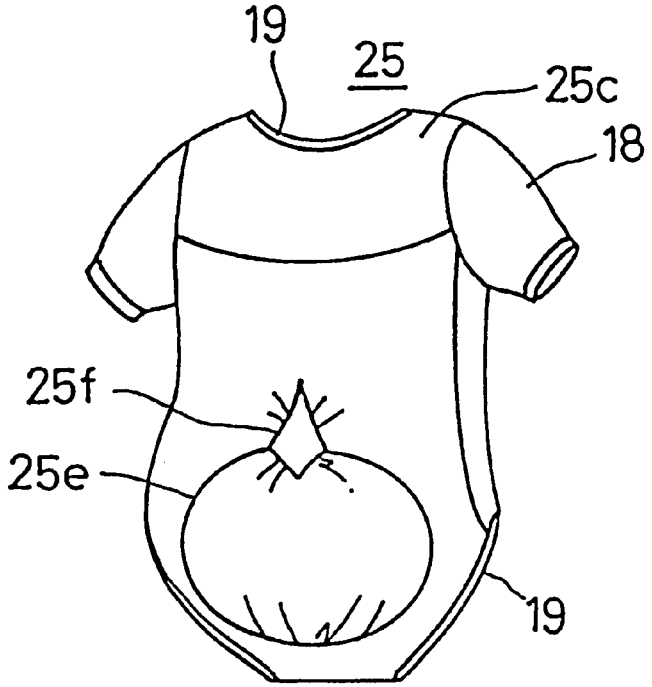

Similarly to the underwear 15 of the first embodiment, in the underwear 25 of the romper type shown in FIGS. 15 and 16, an elliptic part 25*a* corresponding to the baby's belly is formed by plain stitch 3 so that the part 25*a* is elastic greatly lengthwise and widthwise and bulged forward. A part 25*b* corresponding to the crotch and opened and closed by means of the snap 20 is formed of thread knitted by the tammy stitch 5 so that the part 25*b* is elastic in a small extent. A part 25*c* corresponding to the region from an upper portion of the spine to the neck is formed of thread knitted by the pile stitch method 4 so that the part 25*c* has a high degree of perspiration-absorbing performance and air permeability.

The underwear 25 is different from the underwear 15 of the first embodiment in that the thread of right and left sides 25*d* of the underwear 25 is knitted by lengthwise expansion rib stitch 7 which allows the side 25*d* to elongate lengthwise greatly. Similarly to the belly part 25*a*, the thread of a part 25*e* corresponding to the buttocks and partitioned approximately circularly from the remaining parts of the rear body 17 is knitted by the plain stitch 3 so that the part 25*e* is elastic greatly lengthwise and widthwise and bulged rearward. The thread of an approximately rhombic part 25*f* positioned at the center of the back and at the center of the waist at the rear side is knitted by the tammy stitch 5 so that the part 25*f* is elastic in a small extent.

The thread of the remaining parts of the front body 16 and the rear body 17 is knitted by the rib stitch 2. The knitted fabric forming the front body 16 and the rear body 17 continuously is formed by the five kinds of the stitch, namely, the rib stitch 2, the plain stitch 3, the pile stitch 4, the tammy stitch 5, and the lengthwise expansion rib stitch 7.

The sleeve 18 is half-length to allow the arm to be bare and formed of thread knitted by the plain stitch 3, similarly to the underwear 15 of the first embodiment. The thread of the sleeve band 18*a* is knitted by the braid-over-braid knitting method 6 and is not sewn to the sleeve 18. The sleeve band 18*a* is formed of powerful elastic thread so that the sleeve band 18*a* fits to the periphery of the arm.

The part of the underwear 25 corresponding to the periphery of the neck is of cross shoulder type so that the underwear 25 can be easily put on the baby having a big head relative to its body and removed therefrom easily. Piping 19 is attached to the upper edge of the part to be positioned in the periphery of the baby's neck.

At the part of the underwear 25 corresponding to the crotch of the diaper cover type, the end of a folded part 17*a* of the rear body 17 is locked to the lower end front body 16 by a snap 20 at near the belly part 15*a* as compared with the first embodiment.

The underwear 25 having the above-described structure has the same function as that of the underwear 15 of the first embodiment, and the right and left sides thereof are formed by the lengthwise expansion rib stitch 7 so that the right and left elongate greatly. Thus, when the baby raises the hand, turns in the bed or sits, it does not occur that the underwear 25 is not elastic at the right and left sides thereof but is elastic according to the baby's action.

The thread of the buttock part 25*e* is knitted by the plain stitch 3 so that the buttock part 25*e* is elastic greatly lengthwise and widthwise and bulged rearward. Thus, the buttock part 25*e* is elastic according to the shape of the buttocks. Therefore, the back and crotch parts of the underwear 25 are elastic when the baby sits.

Further, because the thread of the rhombic part 25*f* positioned at the center of the waist at the rear side of the underwear 25 is knitted by the tammy stitch 5, the underwear 25 can be prevented from becoming loose at the rear side thereof and fits to the baby's body and allowing the baby to be easily movable. The baby of the second growth stage can support its head by its neck and can be easily lifted in the arms of mother or the like because the underwear 25 does not become loose at the rear side.

Figure 17:
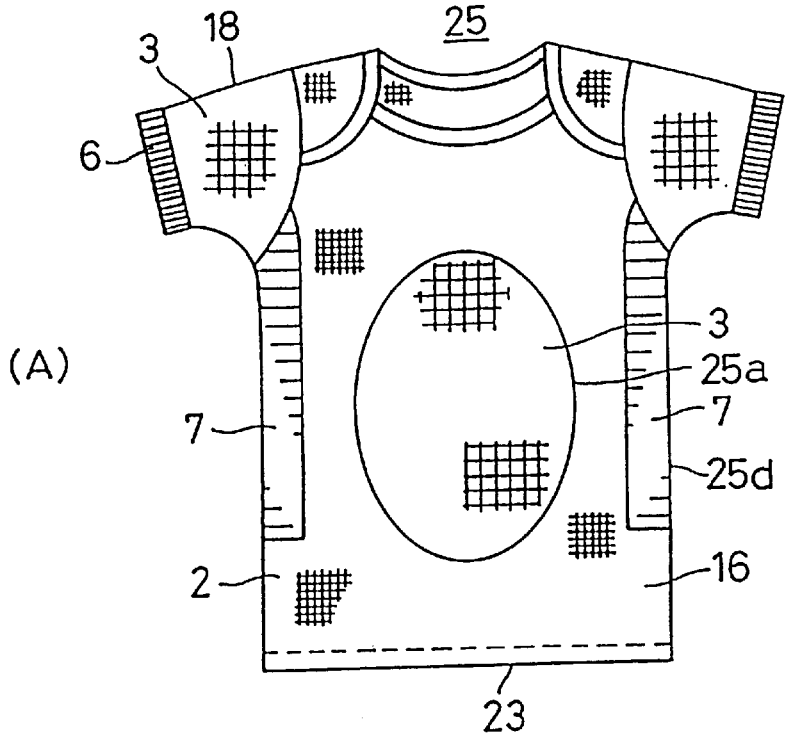
FIG. 17A is a front view showing a modification of the second embodiment.
FIG. 17B is a rear view showing the modification of the second embodiment.
Figure 17:
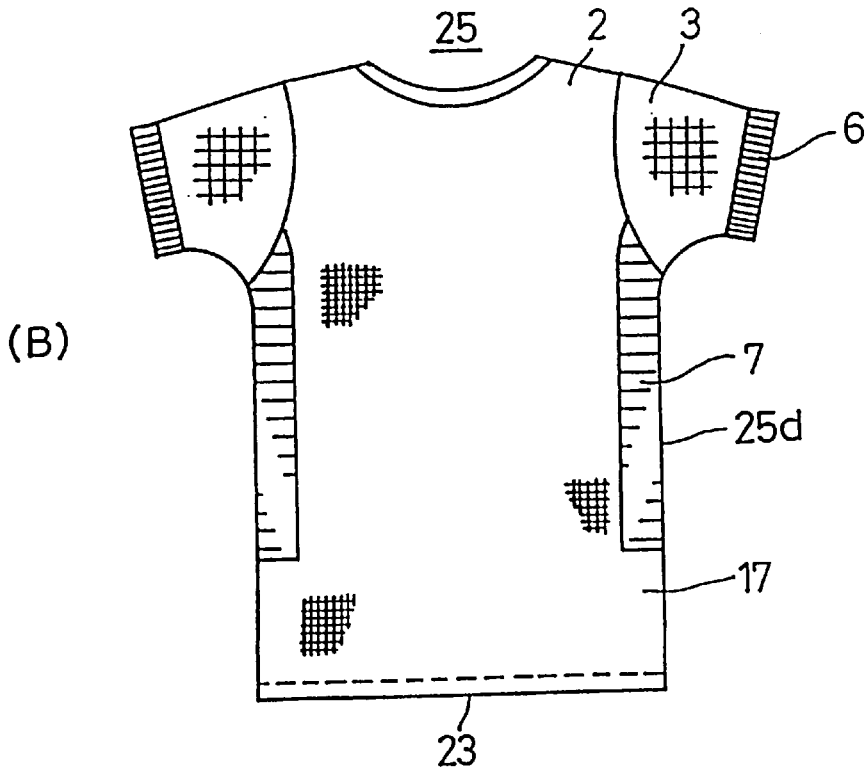
Figure 18:
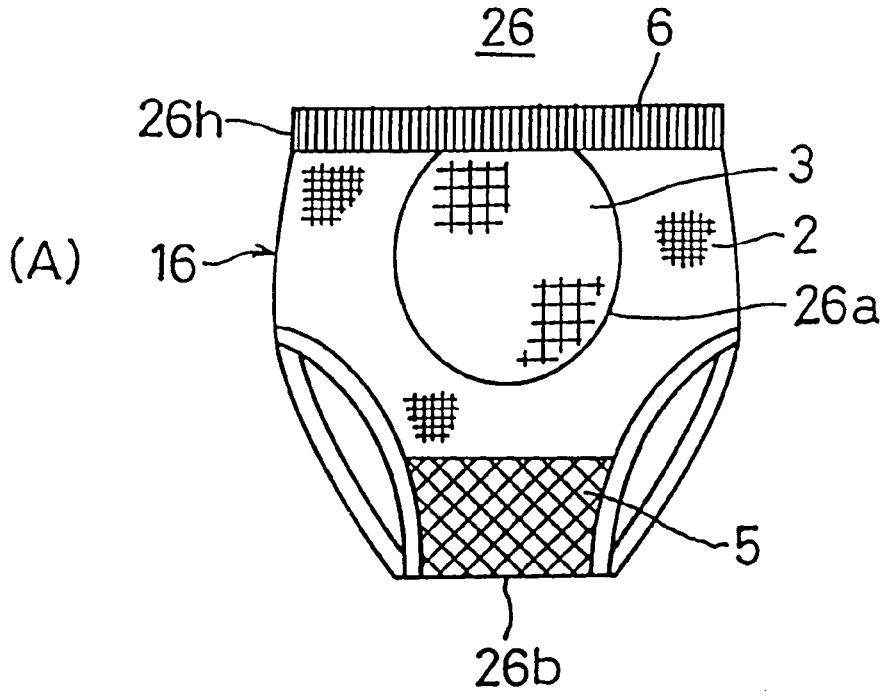
FIG. 18A is a front view showing a panty for a baby of the second growth stage.
FIG. 18B is a rear view showing the panty for a baby of the second growth stage.
Figure 18:
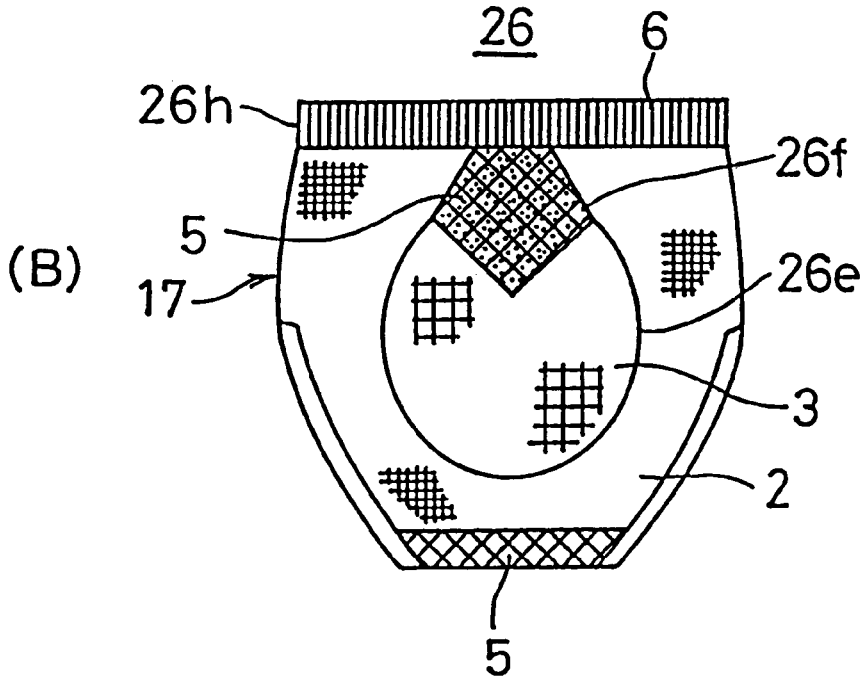
Figure 19:
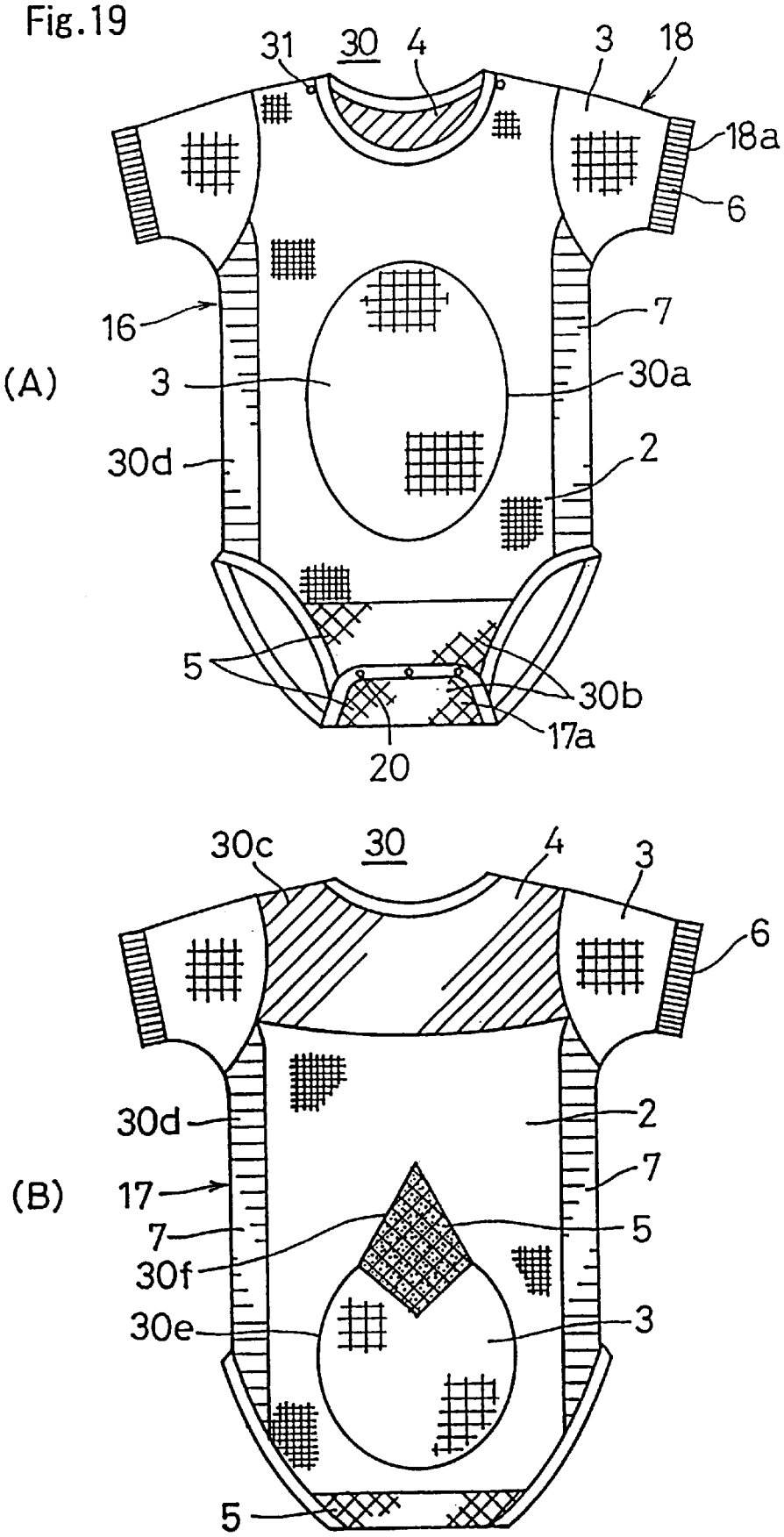
FIG. 19A is a front view showing an underwear of a third embodiment.
FIG. 19B is a rear view showing the underwear of the third embodiment.
Figure 20:
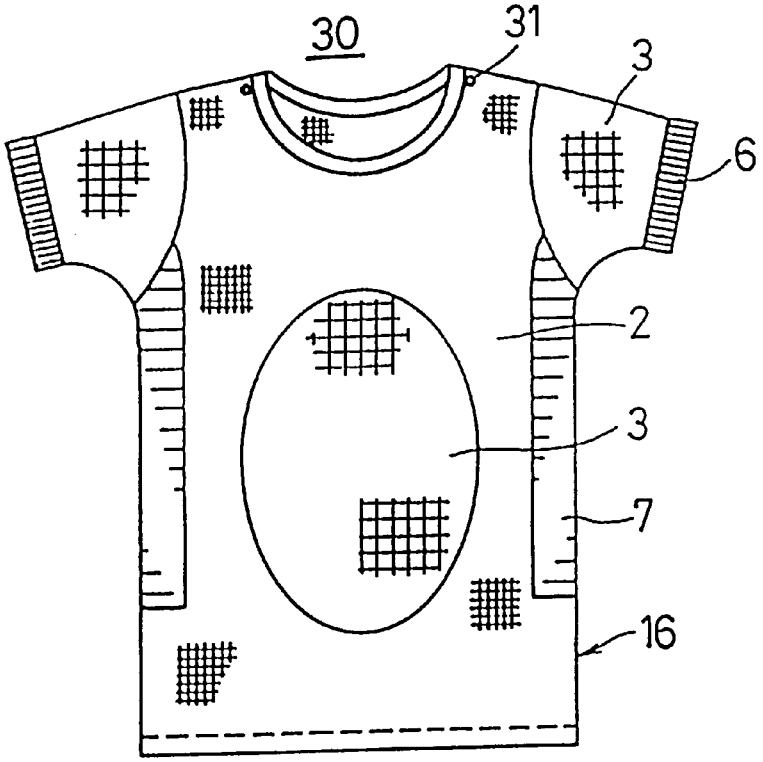
FIG. 20A is a front view showing a modification of the third embodiment.
FIG. 20B is a rear view showing a modification of the third embodiment.
Figure 20:
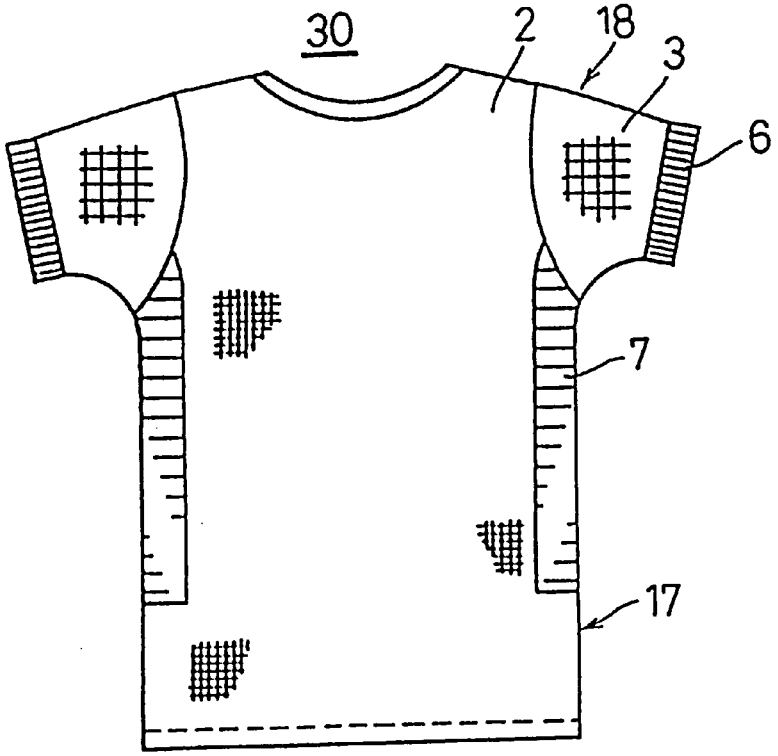

FIG. 17 shows a modification of the second embodiment. The lowermost end 23 of the underwear 15 is cut off to open the lowermost end 23, similarly to the modification of the first embodiment shown in FIG. 5. The lower end 23 of the underwear 25 is folded and sewed but instead, it is possible to treat the lower end 23 by the braid-over-braid knitting method 6 using elastic thread. The underwear 25 of the modification is different from that of the second embodiment in that the thread of the upper part of the back of the rear body 17 is not knitted by the pile stitch. The structures and functions of the other parts of the underwear 25 of the former are the same as those of the latter. Thus, the descriptions of the other parts of the former are omitted herein.

A panty 26 shown in FIGS. 18A and 18B can be also used as bottom clothes for the baby of the third growth stage shown in FIG. 1C and infants under six years old.

The panty 26 is brief-shaped and the length from the crotch to the waist is long to wrap the lower part of the baby's belly so that the panty 26 can be put on a diaper and a diaper cover easily.

The panty 26 is formed of a cylindrical fabric continuously knitted by the circular knitting machine, using thread comprising elastic thread to be used as the inner side thereof and cotton thread to be used as the outer side thereof. In the crotch of the panty 26, the center lower end of the rear body 17 is folded to the front body 16 to sew it to the center lower end of the front body 16. A part 26*a* corresponding to the baby's belly is knitted by the plain stitch 3 so that the belly part 26*a* is elastic greatly lengthwise and widthwise and bulged forward. A part 26*e* corresponding to the baby's buttocks is also formed by the plain stitch 3 so that the buttock part 26*e* is elastic greatly lengthwise and widthwise and bulged rearward. The thread of an approximately rhombic part 26*f* positioned at the center of the waist on the rear side of the pantry 26 is knitted by the tammy stitch 5.

The thread of the upper end 26*h* of the panty 26 positioned at the waist part is knitted by the braid-over-braid knitting method 6, using the powerful elastic thread and not sewn so that the waist part fits to the baby's waist at an appropriate force to prevent the panty 26 from slipping down. In order to prevent the baby's belly from being cooled, it is possible to widen the waist part formed by the braid-over-braid knitting method 6 so that it serves as a belly band. It is possible to form the upper end 26*h* by a knitting method other than the braid-over-braid knitting method 6.

The underwear of the third embodiment is described below with reference to FIGS. 19A and 19B through FIG. 23. The underwear of the third embodiment is used for babies of the third growth stage, namely, those aged about six months to about 15 months. As the formative feature of the baby of the third growth stage, the buttocks thereof grow further and the legs become straight. The baby of the third growth stage becomes active. That is, the period of time in which the baby crawls becomes longer, the baby can stand by holding something in the hand, and can walk by itself. Thus, the clothes to be used for the baby of the third growth stage are required to have a structure of preventing the baby from falling down by treading on the bottom of the clothes when it crawls and walks; allowing the side thereof to be elastic according to various actions of the baby; keeping its shape; and allowing mother or the like to put the clothes on the baby promptly and remove them therefrom promptly.

The underwear shown in FIGS. 19 through 23 are structured in consideration of the above-described points. Thus, the underwear shave structures similar to the structures of the underwear, shown in FIGS. 15 through 17, for the baby of the second growth stage. That is, the underwear 15 of the third embodiment is not of the forward overlapping type, but put on the baby downward from the head. Thus, the cylindrical fabric continuously knitted (shown in FIG. 6) is used as it is as the front body 16 and the rear body 17, and the front body 16 and the rear body 17 are not sewn to each other. Similarly to the first and second embodiments, the sleeve 18 is sewn to the front body 16 and the rear body 17.

Figure 23:
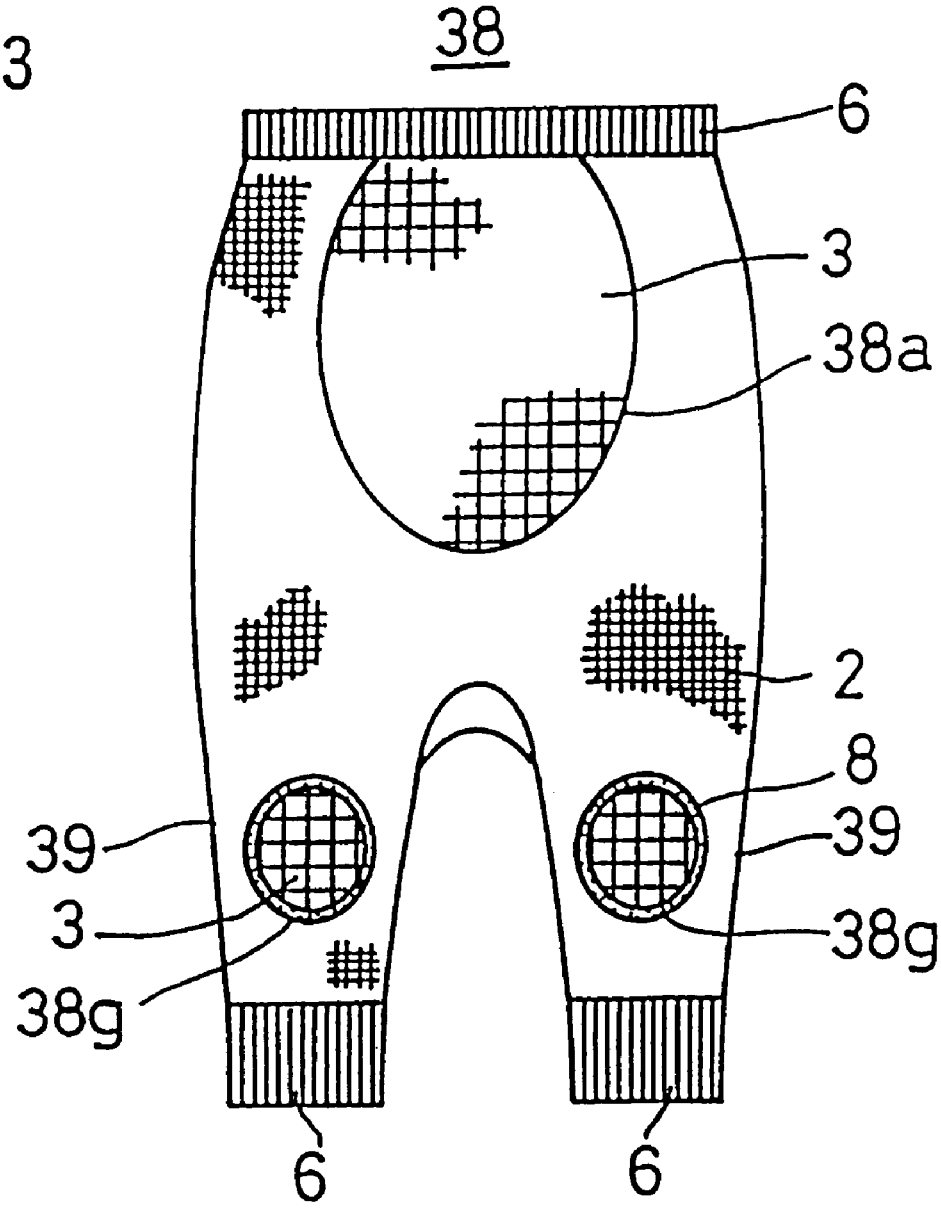
FIG. 23 is a front view showing a modification of the trousers of the third embodiment.

The underwear, shown in FIGS. 19A and 19B, of the third embodiment is of the romper type similar to that shown in FIG. 15. The underwear shown in FIGS. 20A and 20B is a top underwear open at its lower end, similarly to those shown in FIGS. 5 and 17. FIG. 21A and 21B show a trunks type panty, namely, a bottom underwear which is used in combination with the top underwear shown in FIGS. 20A and 20B. FIGS. 22A, 22B, and 23 show trousers.

The structure of the underwear 30 of the romper type shown in FIGS. 19A and 19B is similar to that of the second embodiment in many parts. More specifically, an elliptic part 30*a* corresponding to the baby's belly is formed by the plain stitch 3 so that the belly part 30*a* is elastic greatly lengthwise and widthwise and bulged forward. A part 30*b* corresponding to the baby's crotch and opened and closed by means of the snap 20 is formed of thread knitted by the tammy stitch 5 so that the crotch part 30*b* is elastic in a small extent. A part 30*c* corresponding to the region from an upper portion of the spine to the neck is formed of thread knitted by the pile stitch 4 so that the part 30*c* has a high degree of perspiration-absorbing performance and air permeability. Further, the thread of right and left sides 30*d* of the underwear 30 is knitted by the lengthwise expansion rib stitch 7 which allows the right and left sides 30*d* to elongate lengthwise greatly. Similarly to the belly part 30*a*, the thread of a part 30*e* corresponding to the buttocks and partitioned approximately circularly from the remaining parts of the rear body 17 is knitted by the plain stitch 3 so that the buttock part 30*e* is elastic greatly lengthwise and widthwise and bulged rearward. The thread of an approximately rhombic part 30*f* positioned at the center of the back of the underwear 30 and at the waist of the rear side thereof is knitted by the tammy stitch 5 so that the rhombic part 30*f* is elastic in a small extent. The thread of the remaining parts of the front body 16 and the rear body 17 are knitted by the rib stitch 2. The fabric knitted forming the front body 16 and the rear body 17 continuously is formed by the five kinds of the stitch, namely, the rib stitch 2, the plain stitch 3, the pile stitch 4, the tammy stitch 5, and the lengthwise expansion rib stitch 7. The sleeve 18 is half-length to allow the baby's arm to be bare and formed of thread knitted by the plain stitch 3, similarly to the underwear 15 of the first and second embodiments. The thread of the sleeve band 18*a* is knitted by the braid-over-braid knitting method 6 and is not sewn to the sleeve 18. The sleeve band 18*a* is formed of the powerful elastic thread 10 so that the sleeve band 18*a* fits to the periphery of the arm.

The underwear 30 of the third embodiment is different from the underwear 25 of the second embodiment in that a gripper is attached to a part corresponding to one shoulder part in the periphery of the neck so that the underwear 30 can be promptly put on the baby who does not like to have it put on downward from the head and removed therefrom promptly. That is, a round neck is formed. The front body 16 and the rear body 17 are not sewn to each other in the region from the periphery of the neck to one shoulder but the periphery of the neck is opened and closed with a snap 31. The gripper may be attached to both shoulders.

Because the baby of this growth stage lies on its face in the bed frequently, a folded part 17*a* of the rear body 17 of the underwear 30 is placed at a position lower than the position of the folded part 17*a* of the underwear 25 (see FIG. 15) of the second embodiment so that the folded part 17*a* of the underwear 30 is fixed to the front body 16 with a snap 20. The belly part of the underwear 30 can be prevented from being loose when the baby lies on its face by positioning the snap 20 lower than that of the second embodiment, which increases the actional function of the baby.

The underwear 30 having the above-described structure has the same function as that of the underwear 25 of the second embodiment and can be put on the baby and removed therefrom easily, because the shoulder gripper is attached to the periphery of the neck. In addition, considering that the waist of the baby of the third growth stage grows bigger outstandingly, the belly part of the underwear 30 is bulged forward and the buttock part thereof is bulged rearward, and the thread of both sides thereof is knitted by the lengthwise expansion rib stitch 7. Accordingly, the underwear 30 can be elastic according to the change in the size of the belly part and the buttock part of the baby.

FIGS. 20A and 20B show a modification of the third embodiment. The underwear 30 whose lower end is open is similar to that of the modification (see FIG. 17) of the second embodiment except that the shoulder gripper is attached to the periphery of the neck. Therefore, the description of the underwear 30 of the modification is omitted herein. The upper part of the back of the underwear 30 corresponding to the periphery of the neck thereof is not knitted by the pile stitch 4. Needless to say, it is favorable to knit the upper part of the back of the underwear 30 in the periphery of the neck thereof by the pile stitch 4.

A panty 35 shown in FIGS. 21A and 21B can be also used as bottom clothes for the baby of the second growth stage shown in FIG. 1B and infants under six years old.

Figure 21:
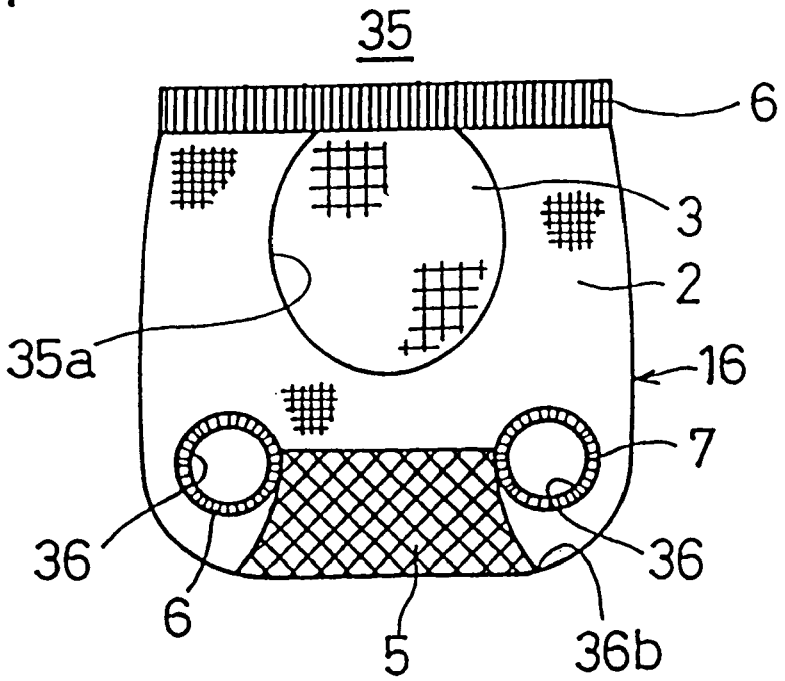
FIG. 21A is a front view showing a panty for of the third growth stage.
FIG. 21B is a rear view showing the panty for a baby of the third growth stage.
Figure 21:
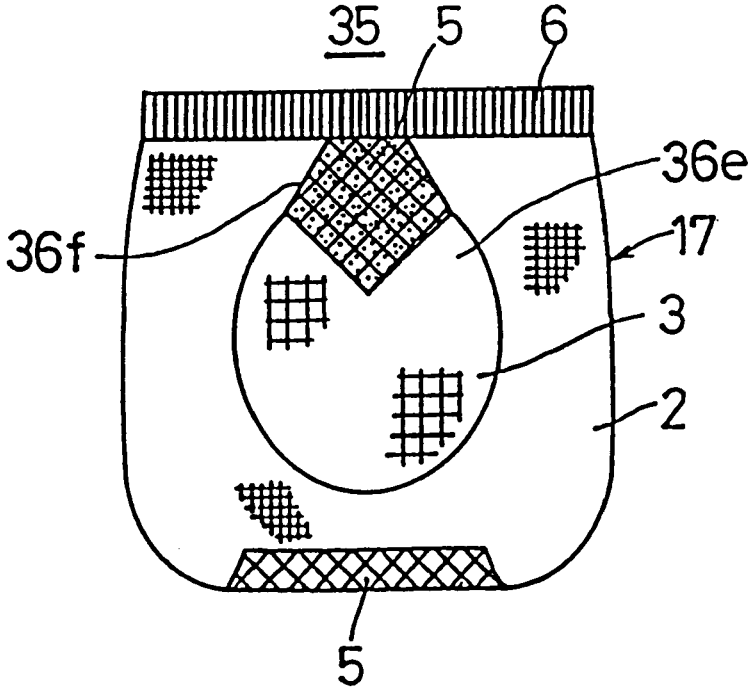
Figure 22:
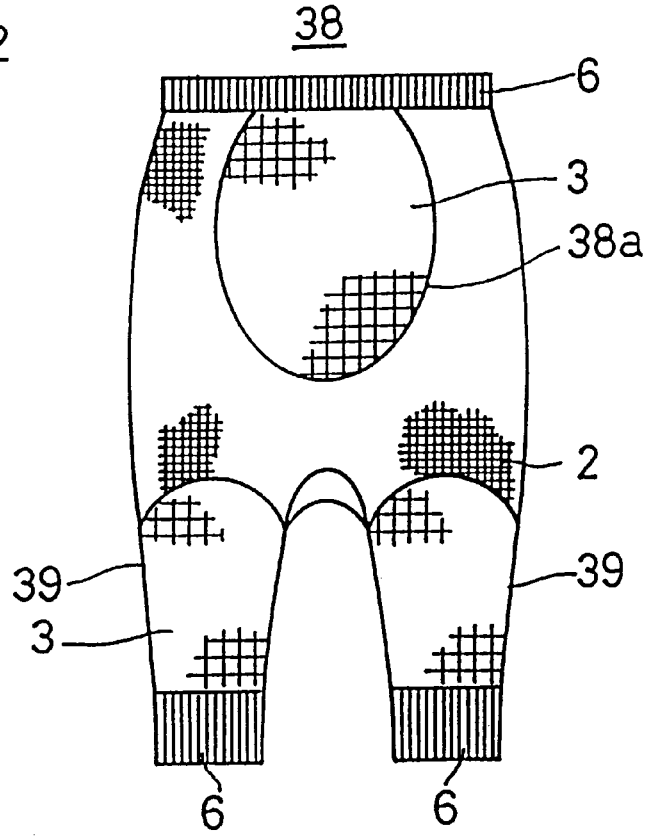
FIG. 22A is a front view showing trousers for a baby of the third growth stage.
FIG. 22B is a rear view showing the trousers for a baby of the third growth stage.
Figure 22:
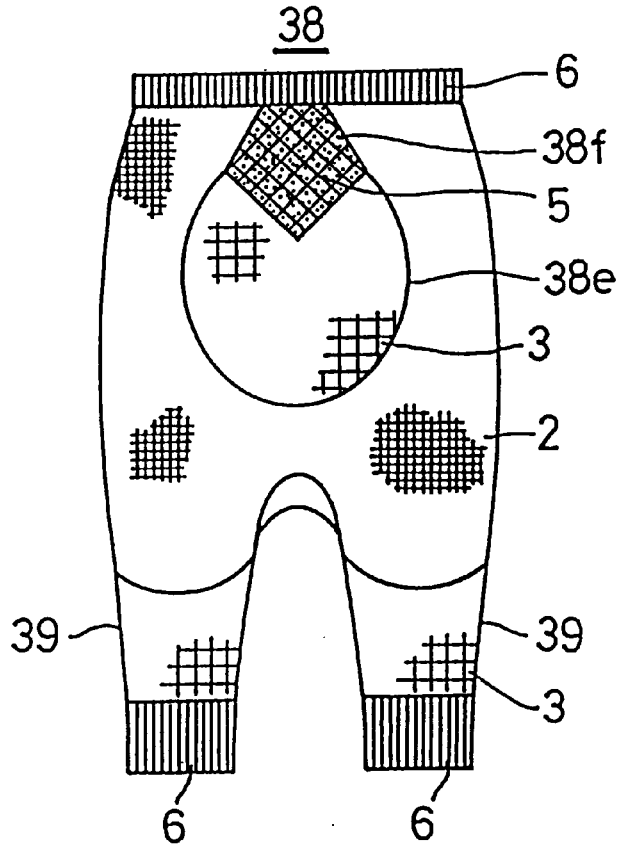

The panty 35 is shaped to wrap up a diaper cover and open end parts 36 is formed at a position corresponding to the base of the baby's thigh. The thread of the part 36 is knitted by the braid-over-braid knitting method 6, using the powerful elastic thread to fit the part 36 to the base of the thigh of the baby. The part 36 is formed on the front body 16 as shown in FIG. 21 so that the baby's legs move forward when the baby sits, crawls, and walks. Because the part 36 is formed at the portion corresponding to the base of the baby's thigh, the part 36 is not sewn to reduce the degree of stimulus to be applied to the skin.

The panty 35 is formed of a cylindrical fabric continuously knitted by the circular knitting machine, using thread comprising elastic thread to be used as the inner side thereof and cotton thread to be used as the outer side thereof. In the crotch part of the panty 35, the center lower end of the rear body 17 is folded to the front body 16 to sew it to the center lower end of the front body 16. The thread of the part 36 at the right and left sides thereof are knitted by the braid-over-braid knitting method 6 in forming the continuous knitted fabric, and the thread of the upper end of the panty 35 positioned at the waist of the baby is knitted by the braid-over-braid knitting method 6, using the powerful elastic thread without sewing the waist part of the panty 35. The waist part formed by the braid-over-braid knitting method 6 fits to the baby's waist at an appropriate force to prevent the panty 35 from slipping down. In order to prevent the baby's belly from being cooled, it is possible to widen the waist part formed by the braid-over-braid knitting method 6 so that it serves as a belly band. Further, a part 35*a* corresponding to baby's belly and a part 36*e* corresponding to the baby's buttocks are formed by the plain stitch 3 so that the belly part 35*a* and the buttock part 36*e* are elastic greatly lengthwise and widthwise and bulged forward and rearward, respectively. The thread of a part 36*b* corresponding to the baby's crotch and that of an approximately rhombic part 36*f* positioned at the center of the waist of the rear side of the panty 35 are knitted by the tammy stitch 5 to prevent the panty 35 from becoming loose at the back side thereof. The thread of the remaining part of the panty 35 is knitted by the rib stitch 2.

Because the waist part and to the upper end of the leg are formed by the braid-over-braid knitting method 6 and not sewn, these parts fit to the baby's body without stimulating the skin. Therefore, the shape of the panty 35 can be kept in any of the stage of sitting, crawling, standing, and walking.

The lower end of right and left leg parts 39 of trousers 38 shown in FIGS. 22A and 22B are positioned below the knee. The part of the trousers 38 from the knee to the lower end thereof is knitted by the plain stitch 3 so that the part is elastic lengthwise and widthwise. The lower ends of the right and left leg parts 39 are formed of the powerful elastic thread knitted by the braid-over-braid knitting method 6. Thus, the parts 39 are not sewn. Similarly to the panty 35, a part 38*a* corresponding to the baby's belly and a part 38*e* corresponding to the baby's buttocks are also formed by the plain stitch 3 so that the belly part 38*a* and the buttock part 38*e* are elastic greatly lengthwise and widthwise and bulged forward and rearward, respectively. The thread of the center 38*f* of the waist part at the rear side of the panty 35 is knitted in an approximately rhombic shape by the tammy stitch 5. Using the powerful elastic thread, the thread of the upper end of the trousers 38 positioned at the baby's waist is knitted by the braid-over-braid knitting method 6 and not sewn. In order to prevent the baby's belly from being cooled, it is possible to widen the waist part formed by the braid-over-braid knitting method 6 so that it serves as a belly band. The thread of the remaining part of the panty 35 is knitted by the rib stitch 2.

The part of the trousers 38 from the knee of the right and left leg parts 39 to the lower end thereof is knitted by the plain stitch 3 so that the right and left leg parts 39 are elastic lengthwise and widthwise, thus being capable of elastic according to the active motion of the baby's legs. The lower ends of the right and left leg parts 39 are formed of the powerful elastic thread knitted by the braid-over-braid knitting method 6 to fit the lower ends of the leg parts 39 to the lower portion of the baby's legs, thus allowing the baby to move easily and accelerating the actional function of the legs. Further, the lower ends of the leg parts 39 fit to any portion of the baby's legs at an appropriate force. When the leg part 39 is long for the legs, the lower ends thereof is capable of fitting to the baby's legs tightly, thus preventing the baby from falling down by treading on the bottom thereof when it crawls or walks. It is possible to form the lower ends of the leg parts 39 by a knitting method other than the braid-over-braid knitting method 6.

FIG. 23 shows a modification of the trousers 38. The right and left leg parts 39 of the modified trousers are formed by the rib stitch 2, similarly to the other parts of the trousers 38. The modified trousers 38 are different from that of third embodiment in that the thread of a circular part 38*g* corresponding to the knee is knitted by the plain stitch 3 so that the circular part 38*g* is elastic vertically and horizontally and that the thread positioned in the periphery of the circular part 38*g* is knitted by mesh stitch 8 (a kind of float stitch) to prevent the periphery of the circle from being expanded in a great extent. The structures of the other parts of the trousers shown in FIG. 21. Thus, the descriptions of the other parts of the modified trousers are omitted herein.

Because the circular knee part 38*g* is formed, the baby can bend and stretch the knee because the thread of the knee part 38*g* is knitted by the plain stitch 3. Because the thread positioned in the periphery of the circular part 38*g* is knitted by the mesh stitch 8, the knee can be prevented from projecting From the circular part 38*g* and hence the shape of the leg parts 39 can be kept for a long time.

Figure 24:
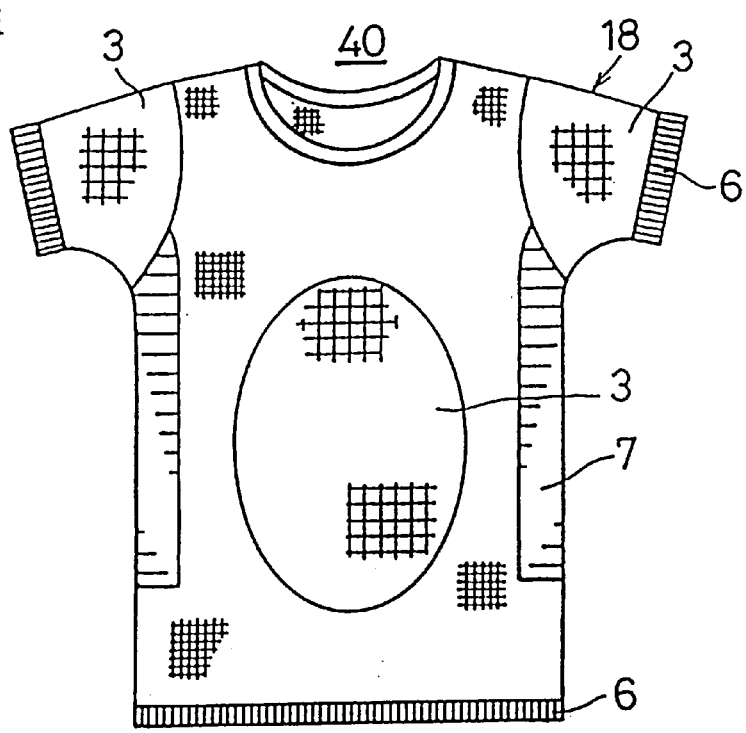
FIG. 24A is a front view showing a modification of top clothes.
FIG. 24B is a rear view showing the modification of the top clothes.
Figure 24:
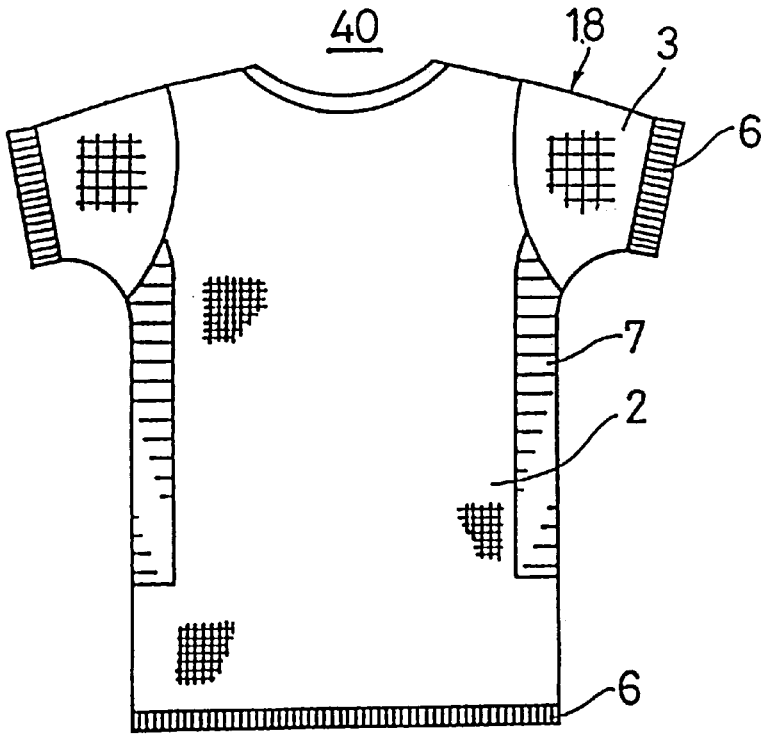

FIGS. 24A and 24B show an underwear 40 which is a top underwear for babies aged about 15 months to about six years old, namely, for small children whose bellies project forward. The underwear shown in FIGS. 24A and 24B is different from that shown in FIG. 20 in that the former has a large round neck and the open lower end thereof is formed of the powerful elastic thread knitted by the braid-over-braid knitting method 6 so that the lower part thereof fits to the baby's body. The structures of other parts of the former are similar to those of the other parts of the underwear shown in FIG. 20. Thus, the descriptions of the other parts of the former are omitted herein. Because at about the age of six, the belly does not project so forward as before, the belly part is knitted by the plain stitch 3 so that the belly part is more elastic than other parts. Hence it is unnecessary to project the belly part.

Frequently, even babies 15 months or older have the romper type underwear worn until it is unnecessary to diaper them. Thus, the romper type underwear of the third embodiment (shown in FIG. 19) having a round neck formed thereon can be preferably used.

Figure 25:
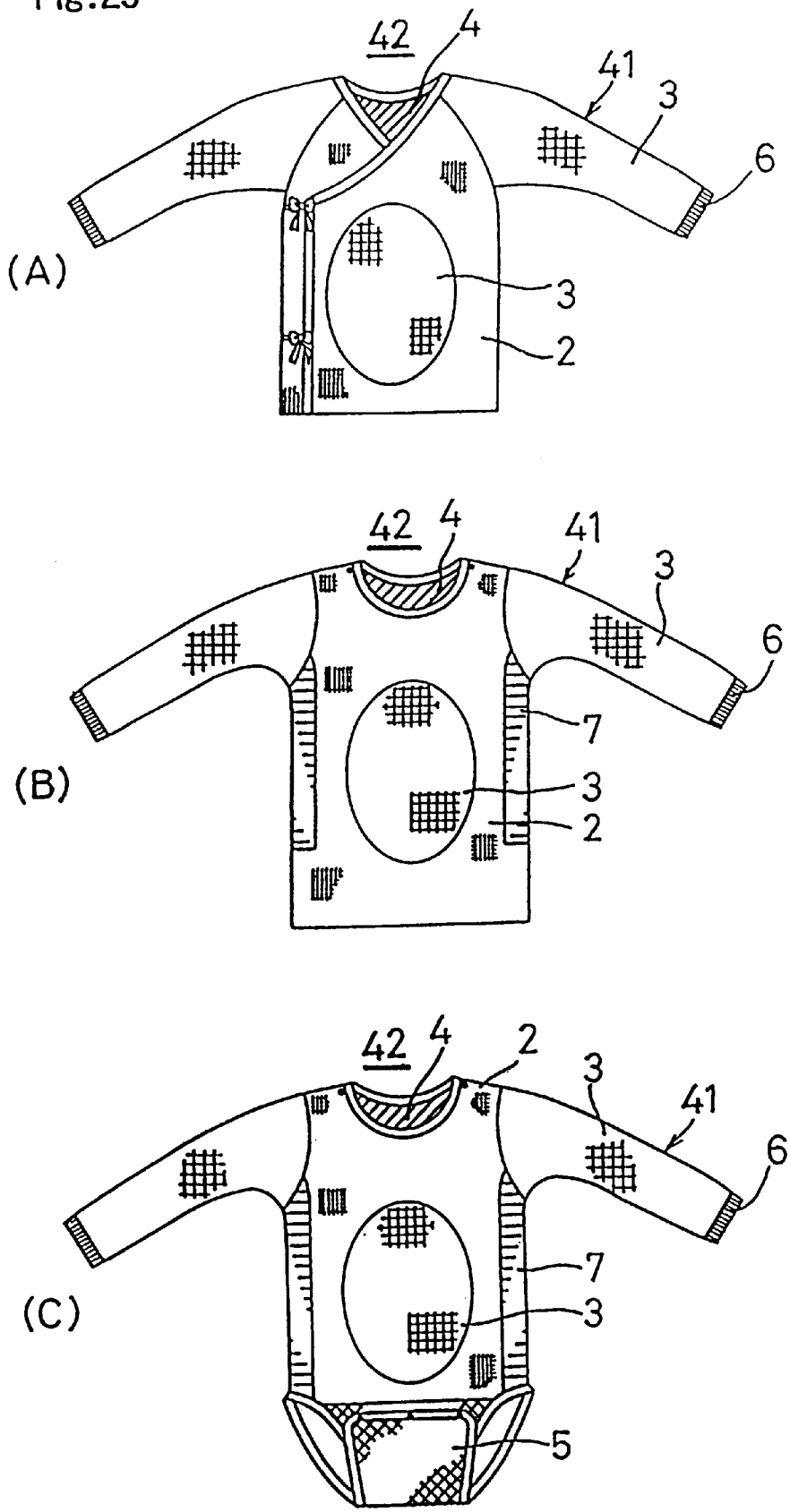
FIGS. 25A, 25B, and 25C are front views showing a modification of the top clothes having a long sleeve.

An underwear 42 shown in FIGS. 25A, 25B, and 25C have long sleeves 41 unlike those of the first, second, and third embodiments. The underwear 42 is composed of continuous round braid thread knitted by the plain stitch 3, and the sleeve band is knitted by braid-over-braid knitting method 6, using the powerful elastic thread.

It is possible to form underwear having no sleeves by removing the half-length sleeves from those of the first through third embodiments.

The underwear of the first through third embodiments can be used as outer clothes. It is possible to color them. They can be used as outdoor clothes by putting designs such as stripes thereon.

INDUSTRIAL APPLICABILITY

As apparent from the foregoing description, because the clothes, of the present invention, for small children including babies and infants' are formed of the knitted fabric comprising the elastic thread, they can be used for a comparatively long time because the knitted fabric expands about 10 cm in the periphery of baby's chest, belly, and waist. Because the clothes are elastic about 10 cm lengthwise and widthwise, they can fit to respective parts of the baby's body without obstructing the baby's motion function and without forming a gap between the clothes and the skin.

Further, because the knitted fabric is constituted of the elastic thread, the knitted fabric is restored to its original shape after washing the clothes and thus the shape thereof lasts for a longer time than the conventional clothes consisting of 100 percent cotton.

In addition, because the clothes are formed of continuous cylindrical fabric formed by the circular knitting machine, the knitted clothes having a small number of sewing parts can be provided, thus not stimulating the skin much. Further, because the elastic thread is a multi-layer structure comprising cotton thread covering the synthesized thread, only the cotton thread contacts the skin, thus stimulating the skin in a small extent.

Thus, in forming the continuous cylindrical knitted fabric, thread of a required part thereof is knitted by a required stitch to allow the required part thereof to be expansive and an unrequired part to be expansive in a small degree so that the clothes are suitable for the baby of each growth stage, namely, the characteristic of the bodily structure and actional characteristic of the baby. Accordingly, the clothes are not tight or loose for the baby's body, thus enhancing the baby's motion function.

Because the thread of a part corresponding to the belly part is knitted by a different method to bulge the belly part to wrap the baby's belly three-dimensionally and the belly part is allowed to be more expansive than other parts of the clothes, the clothes can fit to the baby, thus allowing the baby having a bulged belly to wear the clothes comfortably. It is not preferable to press the baby's belly because the baby of the first growth stage breathes air by abdominal respiration. The clothes of the present invention solves this problem.

Instead of rubber, the sleeve band, the bottom of trousers, and the waist part of the clothes are formed of powerful elastic thread knitted by braid-over-braid and the threads thereof are not sewn. Therefore, these parts can fit to the baby's hands, legs, and waist at an appropriate force, thus allowing the baby to move the body, hands, and legs easily and preventing the clothes from getting out of shape even though the baby takes a very active motion.

The thread of the upper part of the thread is knitted by the pile stitch so that the upper part of the back has a high degree of perspiration-absorbing performance and air permeability. This structure is advantageous in that the baby aged 0–three or four months lying in the bed almost all the time of the day can be prevented from getting wet.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. Clothes for small children, wherein said clothes is an upper body garment having a front and back portion continuously formed of stretchable knitted fabric, said clothes comprising:

a belly portion, located in said front portion, wherein a thread of the belly portion of the front portion is knitted to bulge the belly part thereof to wrap a belly three-dimensionally and allow the belly portion to be more stretchable three-dimensionally than other parts of the clothes so as to provide a bulged area that does not compress a belly of a small child.

2. The clothes according to claim 1, wherein the thread of a belly part of the front body is knitted by a different method to bulge the belly part thereof to wrap a baby's belly three-dimensionally and allow the belly part to be more stretchable than other parts of the clothes.

3. The clothes according to claim 1, wherein the knitted fabric comprises a thread knitted cylindrically by a circular knitting machine such that the front portion and the back portion of the knitted fabric are continuous with each other.

4. The clothes according to claim 1, wherein the knitted fabric comprises an elastic thread having a multi-layer structure formed of polyurethane elastic thread, and cotton thread, one of which is used in an inner side and the other is used in an outer side of the multi-layer structure.

5. The clothes according to claim 1, wherein the knitted fabric of the belly portion is formed with a plain stitch to allow the belly part to be more expansive lengthwise and widthwise, and the remaining portions of the knitted fabric are formed by a float stitch or tuck stitch.

6. The clothes according to claim 1, wherein a sleeve comprising a fabric knitted by an elastic thread is sewn to a top portion of the upper body garment, wherein the thread of the sleeve is knitted by a plain stitch to stretch the sleeve lengthwise and widthwise; and an open end of the sleeve is formed of elastic thread knitted by a braid-over-braid knitting method and not sewn.

7. The clothes according to claim 1, wherein the knitted fabric of an upper part of the back portion is knitted by a pile stitch so that the upper part of the back portion has a high degree of perspiration-absorbing performance and air permeability.

8. The clothes according to claim 1, further comprising a crotch portion of diaper over type, having a fabric positioned at the back portion folded to a fabric positioned at the front portion; and snaps which are attached to both ends of the fabric and are removably fixed, wherein the crotch portion is formed of a thread knitted by a tammy stitch of a kind of float stitch or tuck stitch method to allow the crotch part to be stretchable in a small degree.

9. The clothes according to claim 1, wherein a lower end of the upper body garment is formed of elastic thread knitted by a braid-over-braid knitting method and not sewn.

10. Clothes for small children, wherein said clothes is a lower body garment having a front and rear portion continuously formed of stretchable knitted fabric, said clothes comprising:

a belly portion, located in said front portion, formed with a plain stitch so as to provide a bulged area that does not compress a belly of a small child, wherein said belly portion is more stretchable three-dimensionally than other parts of the clothes;

a crotch portion, located at an area connecting said front portion and said back portion, formed with a tammy stitch so as to hold a weight of a baby's diaper; and a waist part positioned at an upper end of said lower body garment formed of elastic thread knitted by a braid-over-braid knitting method and not sewn.

11. The clothes according to claim 10, wherein the lower body garment is a panty type; and a part thereof corresponding to the base round of each of right and left thighs is formed of elastic thread knitted by a braid-over-braid knitting method and not sewn.

12. The clothes according to claim 10, wherein the lower body garment is a trousers type and includes a part corresponding to a knee of each of right and left legs which is formed of thread knitted by a plain stitch to allow the part to be more expansive lengthwise and widthwise than other parts; and a periphery of the part is formed of thread knitted by a float-mesh stitch to allow the periphery part to be expansive in a small degree.

13. The clothes according to claim 10, wherein the lower body garment is a trousers type and has a part corresponding to a region from a knee to the lower end of each of right and left legs which is formed by a plain stitch so that the part is elastic lengthwise and widthwise.

14. The clothes according to claim 12, wherein the lower end of each of the right and left leg parts is formed of elastic thread knitted by a braid-over-braid knitting method and not sewn.

15. The clothes according to claim 13, wherein the lower end of each of the right and left leg parts is formed of elastic thread knitted by a braid-over-braid knitting method and not sewn.

16. The clothes according to claim 1, wherein the upper body garment consists of an underwear.

17. The clothes according to claim 10, wherein the lower body garment consists of an underwear.

18. Clothes for small children, wherein said clothes is a one-piece garment having upper body and lower body portions continuously formed of stretchable knitted fabric, said clothes comprising:

a belly portion formed with a plain stitch so as to provide a bulged area that does not compress a belly of a small child, wherein said belly portion is more stretchable three-dimensional than other parts of the clothes;

a crotch portion, located at an area connecting said front portion and said back portion, formed with a tammy stitch so as to hold a weight of a baby's diaper;

a preparation-absorbing stitch on said back portion; and a part corresponding to a knee of each of right and left legs which is formed of thread knitted by a plain stitch to allow the part to be more expansive lengthwise and widthwise than other parts of the legs; and a periphery of the part is formed of thread knitted by a float-mesh stitch to allow the periphery part to be expansive in a small degree.

* * * * *